US009544698B2

(12) United States Patent
Kaulberg et al.

(10) Patent No.: US 9,544,698 B2
(45) Date of Patent: Jan. 10, 2017

(54) SIGNAL ENHANCEMENT USING WIRELESS STREAMING

(75) Inventors: Thomas Kaulberg, Smørum (DK); Thomas Bo Elmedyb, Smørum (DK)

(73) Assignee: OTICON A/S, Smorum (DK)

( * ) Notice: Subject to any disclaimer, the term of this patent is extended or adjusted under 35 U.S.C. 154(b) by 607 days.

(21) Appl. No.: 13/320,850

(22) PCT Filed: May 18, 2009

(86) PCT No.: PCT/EP2009/055969

§ 371 (c)(1),
(2), (4) Date: Nov. 16, 2011

(87) PCT Pub. No.: WO2010/133246

PCT Pub. Date: Nov. 25, 2010

(65) Prior Publication Data

US 2012/0063610 A1 Mar. 15, 2012

(51) Int. Cl.
*G10L 21/0208* (2013.01)
*H04R 25/00* (2006.01)

(52) U.S. Cl.
CPC ..... *H04R 25/554* (2013.01); *H04R 25/407* (2013.01); *H04R 25/43* (2013.01)

(58) Field of Classification Search
CPC ..... H04R 2410/05; H04R 1/1083; H04R 2430/25; H04R 2410/01; G10L 21/0208; H04B 15/00

(Continued)

(56) References Cited

U.S. PATENT DOCUMENTS 4,536,887 A 8/1985 Kaneda et al.
2004/0136557 A1 7/2004 Kaulberg
(Continued)

FOREIGN PATENT DOCUMENTS

EP 0579152 B1 3/2000
EP 1107472 A2 6/2001
(Continued)

OTHER PUBLICATIONS

Boll, "Suppression of Acoustic Noise in Speech Using Spectral Subtraction", IEEE Transactions on Acoustics, Speech, and Signal Processing, vol. ASSP-27, No. 2, Apr. 1979, pp. 113-120.
(Continued)

*Primary Examiner* — George Monikang
(74) *Attorney, Agent, or Firm* — Birch, Stewart, Kolasch & Birch, LLP

(57) ABSTRACT

A method, device and system enhance an audio signal in a receiving device. The method comprises acoustically propagating a target signal from an acoustic source along an acoustic propagation path, providing a propagated acoustic signal at the receiving device; converting the received propagated acoustic signal to a propagated electric signal, the received propagated acoustic signal comprising the target signal, noise and possible other sounds from the environment as modified by the propagation path from the acoustic source to the receiving device; wirelessly transmitting a signal comprising the target audio signal to the receiving device; receiving the wirelessly transmitted signal in the receiving device; retrieving a streamed target audio signal from the wirelessly received signal comprising the target audio signal; and estimating the target signal from the propagated electric signal and the streamed target audio signal using an adaptive system.

26 Claims, 12 Drawing Sheets

(58) Field of Classification Search
USPC ..... 381/71.1, 92, 94.1–94.3
See application file for complete search history.

(56) References Cited

U.S. PATENT DOCUMENTS

| | | | | |
|---|---|---|---|---|
| 2005/0110700 | A1 | 5/2005 | Terry | |
| 2005/0255843 | A1 | 11/2005 | Hilpisch et al. | |
| 2008/0013763 | A1 | 1/2008 | Lotter et al. | |
| 2010/0062713 | A1* | 3/2010 | Blamey ..... | H04M 9/082 455/41.3 |

FOREIGN PATENT DOCUMENTS

| | | | |
|---|---|---|---|
| EP | 1395080 | A2 | 3/2004 |
| EP | 1691573 | A2 | 8/2006 |
| EP | 1718114 | A1 | 11/2006 |
| EP | 1956589 | A1 | 8/2008 |
| WO | WO 03/081947 | A1 | 10/2003 |
| WO | WO 2004/077090 | A1 | 9/2004 |
| WO | WO 2005/053179 | A1 | 6/2005 |
| WO | WO 2005/055654 | A1 | 6/2005 |
| WO | WO 2005/086536 | A1 | 9/2005 |
| WO | WO 2007/099420 | A1 | 9/2007 |
| WO | WO 2008/071236 | A2 | 6/2008 |
| WO | WO 2008/083712 | A1 | 7/2008 |

OTHER PUBLICATIONS

Makhoul, "Linear Prediction: A Tutorial Review", Proceedings of the IEEE, vol. 63, No. 4, Apr. 1975, pp. 561-580.

Rabiner, "A Tutorial on Hidden Markov Models and Selected Applications in Speech Recognition", Proceedings of the IEEE, vol. 77, No. 2, Feb. 1989, pp. 257-286.

Widrow et al., "Adaptive Noise Cancelling: Principles and Applications", Proceedings of the IEEE, vol. 63, No. 12, Dec. 1975, pp. 1692-1716.

* cited by examiner

SIGNAL ENHANCEMENT USING WIRELESS STREAMING

TECHNICAL FIELD

The present invention relates to a method of, a device (and its use) and a system for enhancing the signal quality of an audio signal, e.g. in connection with the propagation of an audio signal to a listening device, e.g. a hearing aid. The invention further relates to a data processing system and to a computer readable medium.

The invention may e.g. be useful in applications such as listening devices, e.g. hearing aids, receiving audio sound from a signal source via an acoustic path.

BACKGROUND ART

In many wireless audio streaming scenarios the acoustical audio signal is present in parallel to a corresponding wireless electromagnetic signal, e.g. audio streaming from a TV, audio streaming in a class room, etc. The misalignment in time between the streamed audio signal and the acoustic audio signal is in many situations a problem. If the misalignment is more than 10 ms, sound quality begins to drop. If the misalignment is increased even more, audio-visual non-synchronicity begins to appear. If the delay is more than 50 ms, audio-visual non-synchronicity like e.g. lip-reading makes the situation quite unpleasant and decreases speech intelligibility.

The present invention proposes among other things a solution to this problem.

DISCLOSURE OF INVENTION

The present invention deals in general with signal enhancement in listening systems. Embodiments of the invention relate to the handling of delay differences between acoustically propagated and wirelessly transmitted audio signals. Embodiments of the invention deal with the treatment of audio signals, which are to accompany video-images or real ('live') images of persons or scenes to be simultaneously perceived by a viewer. The idea is—in addition to the acoustically propagated audio signal—to wirelessly transmit (stream) the audio signal from an audio source, e.g. a TV-set or a wired or wireless microphone, to an audio receiver, e.g. a hearing aid.

In embodiments of the invention, the streamed audio signal is mainly used for building a signal model of the streamed signal source. This model is used to increase the signal-to-noise ratio of the acoustically propagated and received audio signal because the model can be used to determine which part of the input (signal+noise) is dominated by the signal, and which part is dominated by the noise.

In noise reduction algorithms, it is known to subtract an estimate of the noise from the mixed signal comprising signal and noise. In embodiments of the present invention, the 'opposite' is done in that the 'clean' version of the signal (the streamed audio signal) is used to extract characteristics of the target signal part of the received, acoustically propagated signal. Characteristics of the target signal include its frequency spectrum, periodicity, modulation at different frequencies f (e.g. modulation index, MI(f), top and bottom trackers, TT(f), BT(f), respectively) onset/offset characteristics, input level, etc. The extracted characteristics (the model) of the target signal can e.g. be used to adapt possible noise reduction and compression algorithms to provide the same characteristics in the processed version of the received acoustically propagated signal. Such processing can e.g. be performed in a signal processing unit of a listening device.

The present scheme can further be used e.g. to filter out noise from distinct sources, e.g. a ventilator, a household appliance or the like using a directional microphone system or, alternatively, if the noise has its origin from in front of the person wearing the hearing aid, to reduce it using a noise reduction algorithm.

Similarly, the concept can be used in connection with 'own voice detection' by using a specific 'own voice detector' to extract characteristics of the 'own voice' and wirelessly transmit those characteristics (or alternatively the full audio signal comprising 'own voice') to a hearing aid of another listening person, which can then be specifically 'tuned' to the reception of that particular voice.

Alternatively, the concept can be used to add spatial information about the present location of a user (e.g. a particular room) to a wirelessly streamed audio signal with the purpose of adding directional information, etc., to the otherwise 'clean' streamed signal.

An object of embodiments of the present invention is to provide a scheme for improving signal quality of an audio signal received by a listening device.

Objects of the invention are achieved by the invention described in the accompanying claims and as described in the following.

A Method of Enhancing an Audio Signal:

An object of the invention is achieved by a method of enhancing an audio signal in a receiving device. The method comprises,

- Acoustically propagating a target signal from an acoustic source along an acoustic propagation path, providing a propagated acoustic signal at the receiving device;
- Converting the received propagated acoustic signal to a propagated electric signal, the received propagated acoustic signal comprising the target signal, noise and possible other sounds from the environment as modified by the propagation path from the acoustic source to the receiving device;
- Wirelessly transmitting a signal comprising the target audio signal to the receiving device;
- Receiving the wirelessly transmitted signal in the receiving device;
- Retrieving a streamed target audio signal from the wirelessly received signal comprising the target audio signal; and
- Estimating the target signal from the propagated electric signal and the streamed target audio signal using an adaptive system.

An advantage of the invention is that a target signal is enhanced.

Another advantage of embodiments of the invention is that the acoustically propagated signal is enhanced without introducing a further delay in its propagation path.

Another advantage of embodiments of the invention is that the streamed signal can be used to precisely estimate the impulse response of the path from the loud speaker generating the (acoustic version of the) audio signal to the microphone of the listening device, e.g. a hearing aid (i.e. dependent of the room in which the user is located). This estimate can then be more precisely de-convolved in the listening device (than if the source signal is unknown).

In the present context, the term 'streaming', refers to the transmission and reception of a (typically digital, e.g. encoded) signal, typically representing audio or video data, which is continuously generated (or transmitted from a stored file) and presented to a user or used in a medium as it is received. Typically, the streamed signal is presented to a user as it is received, without being permanently stored (apart from necessary buffering).

In the present context, the term an adaptive system, refers to a system that is able to respond to changes in its inputs. An adaptive system typically comprises a feedback loop. An example of an adaptive system is an adaptive filter comprising a variable filter part and an update algorithm part, the variable filter part providing a transfer function that is automatically adjusted to changing inputs based on an optimizing algorithm of the update algorithm part.

In an embodiment, the receiving device is adapted to be able to perform signal processing in separate frequency ranges or bands.

In an embodiment, the input side of the forward path of the receiving device comprises an AD-conversion unit for sampling an analogue electric input signal with a sampling frequency $f_s$ and providing as an output a digitized electric input signal comprising digital time samples $s_n$ of the input signal (amplitude) at consecutive points in time $t_n=n*(1/f_s)$, where n is an integer. The duration in time of a sample is thus given by $T_s=1/f_s$. In general, the sampling frequency is adapted to the application (available bandwidth, power consuption, frequency content of input signal, necessary accuracy, etc.). In an embodiment, the sampling frequency $f_s$ is in the range from 8 kHz to 40 kHz, e.g. around 16 kHz.

In an embodiment, the receiving device comprises a TF-conversion unit for providing a time-frequency representation of a signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the receiving device from a minimum frequency $f_{min}$ to a maximum frequency $f_{max}$ comprises a part of the typical human audible frequency range from 20 Hz to 20 kHz, e.g. from 20 Hz to 12 kHz. In an embodiment, the frequency range $f_{min}$-$f_{max}$ considered by the receiving device is split into a number P of frequency bands, where P is e.g. larger than 5, such as larger than 10, such as larger than 50, such as larger than 100, at least some of which are processed individually.

In a particular embodiment, the method comprises estimating the delay difference between the propagated electric signal and the streamed target audio signal or signals originating there from. Which one of the signals that arrives first in the receiving device in (electrical form) will depend on the physical length of the acoustic propagation path and the latency of the wireless link, e.g. on delays in transceivers of the wireless transmission path (including in possible coding-decoding units, modulation-demodulation units, etc.) for transmitting and receiving the electromagnetic signal, and on delays in the input transducer, possible front-end amplifiers and/or other processing of the acoustically propagated signal during reception, etc. In some applications, the (acoustically) propagated electric signal will have the lowest delay. This may e.g. the case, if the wireless link is based on inductive coupling between transmitter and receiver. In other cases the (electromagnetically) streamed target audio signal will have the lowest delay. This may e.g. be the case, if the wireless link is based on radiated fields.

In a particular embodiment, the method comprises using the resulting delay difference in the estimation of the target signal.

In an aspect of the invention, the idea is to use the streamed audio signal ONLY for building a signal model of the streamed signal source. This model is used in a signal enhancement system like e.g. the "Spectral Subtraction" algorithm (see e.g. [Boll, 1979]). This type of algorithm uses an estimate of the noise and by comparing this estimate with the input (signal+noise) the optimal gain is calculated. According to the present invention, a perfect estimate of the signal is available (the streamed target audio signal) and by comparing this to the input (signal+noise) we can calculate an optimal gain (we can call this a reversed Spectral Subtraction or a Spectral Enhancement algorithm). Alternatively, a Wiener filter could be used (cf. e.g. [Widrow et al., 1975]).

Some algorithms use the signal estimate directly, e.g. the formant tracking algorithms like HMM (Hidden Markov Model) (see e.g. [Rabiner, 1989]) or Linear Prediction methods (see e.g. [Makhoul, 1975]). In this case, the streamed signal is used to extract signal model information like formants, spectral shape, etc., and use this in the enhancement algorithm.

According to an aspect of the present invention, the streamed signal is NOT used in the direct signal path (the streamed signal is not presented to a user, cf. e.g. embodiments of FIG. 2*b*, 2*c*, 2*g*, 3*a*, 3*b*, 5. 7*a*, 8, 12*a*). It is mainly used to extract information about the acoustically propagated target signal (such information (the model) being passed to the Signal Enhancement algorithm for estimating (enhancing) the target signal). In this way we do not have any problems with the link delay because the model can be updated quite slowly and we can expect a significant increase in the signal-to-noise ratio.

In embodiments of this aspect of the invention, the method comprises estimating the target signal from the propagated electric signal using the streamed target audio signal or a signal derived there from as an input to the adaptive algorithm to improve the estimate of the target signal. Here, the (possibly delayed) propagated electric signal is e.g. fed to the variable filter part of an adaptive filter whereas the (possibly delayed) streamed target audio signal is used in the algorithm part of the adaptive filter to update filter coefficients of the variable filter part. This has the advantage of increasing the signal to noise ratio of the propagated electric signal.

In another aspect of the present invention, the acoustically propagated signal is used to add spatial information about the present location of a user (e.g. a particular room) to a wirelessly streamed audio signal with the purpose of adding directional information, etc., to the otherwise 'clean' streamed signal (the resulting 'enhanced' streamed signal being presented to a user, cf. e.g. embodiments of FIG. 2*d*, 2*e*, 6, 7*b*).

In embodiments of this aspect of the invention, the method comprises estimating the target signal from the streamed target audio signal using the propagated electric signal or a signal derived there from as an input to the adaptive algorithm to improve the estimate of the target signal. This can e.g. be implemented by an adaptive filter by feeding the (possibly delayed) streamed target audio signal to the variable filter part of an adaptive filter whereas the (possibly delayed), propagated electric signal is used in the algorithm part of the adaptive filter to update filter coefficients of the variable filter part.

In a particular embodiment, the method comprises delaying the relevant one of the signals, the estimate of the target signal, the propagated electric signal and the streamed target audio signal, or signals originating there from with the estimated delay difference; and using the resulting signal in the estimation of the target signal.

In a particular embodiment, the method comprises extracting characteristics of the target signal from the streamed target audio signal.

In an embodiment, the method additionally comprises extracting characteristics of the target signal from the propagated electric signal. In an embodiment, the characteristics of the target signal include one or more of the following: the frequency spectrum, modulation at different frequencies (e.g. modulation index, e.g. top and bottom trackers of a modulation index vs. frequency), onset/offset characteristics, input level, etc. In an embodiment, the method comprises comparing corresponding characteristics (e.g. modulation index or input level) of extracted from the streamed target audio signal and the propagated electric signal, respectively.

In a particular embodiment, the method comprises using the extracted characteristics of the streamed target audio signal as inputs to processing algorithms for improving the estimated target signal. In an embodiment, the method comprises using a comparison of corresponding characteristics (e.g. modulation index or input level) extracted from the streamed target audio signal and the propagated electric signal, respectively as inputs to processing algorithms for improving the estimated target signal. In an embodiment, algorithms comprise one or more algorithms for processing of gain, directionality, noise reduction or compression, etc., to appropriately adapt (enhance) characteristics of the target signal estimate.

In an embodiment, the estimated target signal is further improved in further processing algorithms, e.g. by adapting the estimated target signal according to a user's needs.

In a particular embodiment, the extracted characteristics of the streamed target audio signal or a comparison between characteristics of the streamed target audio signal and the propagated electric signal are used to compensate for non-linearities in loudspeakers in a room, thereby an improved sound quality can be provided, while maintaining other sounds from the environment. This has the advantage that the resulting estimated version of the target sound signal is NOT 'destroyed' by bad components in loudspeaker(s) providing the sound source target signal.

In a particular embodiment, the extracted characteristics of the streamed target audio signal or a comparison between characteristics of the streamed target audio signal and the propagated electric signal are used to remove noise from distinct audio sources in the environment of the receiving device, e.g. from a household appliance, e.g. a dish washing machine, a ventilator, etc.

In a particular embodiment, the method comprises extracting characteristics of the acoustic propagation path from the propagated acoustic signal.

In a particular embodiment, the characteristics of the acoustic propagation path include one or more of the following: interaural difference cues, distance information, intensity, direct to reverberant energy ratio, room impression.

In a particular embodiment, the extracted characteristics of the acoustic propagation path are used to add spatial information to the target signal estimate, e.g. characteristics of the room, reflections, background sounds, directional cues, reverberation, etc.

In a particular embodiment, the propagated acoustic signal is attenuated, e.g. cancelled, in or by the receiving device before being presented to a user, e.g. in hearing aids or headphones to be able to fully control the sound presented to a user.

In an embodiment, the method is used in a listening device, e.g. a protective device, a head phone or a headset, a hearing aid or a pair of hearing aids of a binaural fitting. An advantage of embodiments of the invention is that the delay problem is solved, and further that the user gets the audio signal through their own ears (via the hearing aid, i.e.) including additional background sounds, so that an experience of being cut-off from the environment is avoided. A further advantage of embodiments of the invention is that the target signal is enhanced compared to the acoustically of wirelessly propagated signals comprising the target signal.

Audio Enhancement Device:

An audio enhancement device for enhancing an audio signal is furthermore provided by the present invention. The audio enhancement device comprises at least one input transducer for converting a propagated acoustic signal comprising a target signal propagated from an acoustic source along an acoustic propagation path to the audio enhancement device to a propagated electric signal;

a wireless receiver for receiving a target audio signal via a wireless link and providing a streamed target audio signal; and a first adaptive system for estimating said target signal based on said propagated electric input signal and said streamed target audio signal.

It is intended that the process features of the method described above, in the detailed description of Thode(s) for carrying out the invention' and in the claims can be combined with the (audio enhancement) device, when appropriately substituted by a corresponding structural feature and vice versa. Embodiments of the device have the same advantages as the corresponding method.

In a particular embodiment, the audio enhancement device comprises a first estimator unit for estimating the delay difference between the propagated electric signal and the streamed target audio signal or signals originating there from. In a particular embodiment, the audio enhancement device is adapted for using the resulting delay difference in the estimation of the target signal.

In a particular embodiment, the first adaptive system is adapted to base its estimate of the target signal on the propagated electric input signal and said estimated delay difference.

In a particular embodiment, the first adaptive system is adapted to base its estimate of the target signal on the streamed target audio signal and said estimated delay difference.

In a particular embodiment, the audio enhancement device comprises a second estimator unit for estimating characteristics of the target signal from the streamed target audio signal. In an embodiment, the characteristics of the target signal include one or more of the following: the frequency spectrum, modulation at different frequencies (e.g. modulation index, e.g. top and bottom trackers of a modulation index vs. frequency), onset/offset characteristics, etc. In a particular embodiment, the audio enhancement device is adapted to provide that the extracted characteristics of the streamed target audio signal are used to as inputs to processing algorithms for improving the target signal. In an embodiment, the estimated target signal is thereby improved (e.g. according to a user's needs), e.g. by adapting algorithms for gain, directionality, noise reduction or compression, etc., to provide the same characteristics in the processed version of the target signal estimate as in the streamed target audio signal.

In a particular embodiment, the audio enhancement device comprises a third estimator unit for estimating characteristics of the acoustic propagation path from the propagated acoustic signal. In a particular embodiment, the characteristics of the acoustic propagation path include one or more of the following: interaural difference cues, distance information, intensity, direct to reverberant energy ratio, room impression. In a particular embodiment, the audio enhancement device is adapted to provide that the extracted characteristics of the acoustic propagation path are used to add spatial information to the target signal estimate. In a particular embodiment, the spatial information comprises e.g. characteristics of the room, reflections, background sounds, directional cues, reverberation, etc.

In a particular embodiment, said first adaptive system comprises an adaptive filter for providing said estimate of the target signal, the adaptive filter comprising an algorithm part and a variable filter part where the algorithm part is adapted to update a filter characteristic of the variable filter part.

In a particular embodiment, the first estimator unit comprises an adaptive filter for providing said estimate of the delay difference.

In a particular embodiment, the audio enhancement device comprises a signal processing unit for further processing said estimate of the target signal, e.g. for running processing algorithms for improving the target signal and/or for adding spatial information to the estimate of the target signal. The signal processing unit may be adapted to further process the estimate of the target signal according to a user's needs.

In a particular embodiment, the audio enhancement device comprises an output transducer for presenting the estimate of the target signal or an output from said signal processing unit comprising a further processing of said estimate of the target signal to a user. In an embodiment, the audio enhancement device comprises an output transducer for presenting the estimate of the target signal or an output from said signal processing unit comprising a further processing of said estimate of the target signal as a stimulus adapted to be perceived by a user as an output sound (e.g. an output transducer (such as a number of electrodes) of a cochlear implant or of a bone conducting hearing device.

In an embodiment, the audio enhancement device form part of a listening device, e.g. a hearing instrument, a head set, a head phone, or an ear protection device, or a combination thereof.

Audio Enhancement System:

An audio enhancement system is moreover provided by the present invention. The audio enhancement system comprises an audio source for generating an acoustic target signal and a transmitting device for generating a wireless signal comprising a representation of said target signal in the form of a target audio signal and a receiving device comprising an audio enhancement device as described above, in the detailed description of 'mode(s) for carrying out the invention' and in the claims.

In a particular embodiment, the transmitting device is embodied in an entertainment device comprising a microphone and/or produce images and accompanying sound signals. The transmitting device, can e.g. be an A/V device (A/V=Audio/Visual), e.g. a TV-set, a PC, a wired or wireless microphone, a karaoke system, etc. In an embodiment, the entertainment device comprises a loudspeaker for propagating a target sound, a wireless transmitter for electromagnetically propagating the sound and a microphone for picking up a target sound (or a part thereof) from a speaker or singer or another intended sound from the environment. In an embodiment, such device comprising a microphone comprises a PC and/or a karaoke-device.

In a particular embodiment, the receiving device is embodied in a listening device, e.g. a body-worn listening device, e.g. comprising a headphone, a head set, an ear protection device and/or a hearing instrument.

In an embodiment, the audio source comprises a loudspeaker.

In an embodiment, the audio source is embodied in an entertainment device comprising images and accompanying sound signals (such as an NV device, e.g. a TV-set or a PC).

In an embodiment, the audio source and said transmitting device are integrated in one physical device comprising a common housing.

In an embodiment, the audio source is a voice, e.g. a voice of a human being.

In an embodiment, the transmitting device comprises a microphone or a listening device adapted for being worn by a user and comprising an 'own voice detector' for detecting and extracting the users own voice or characteristics thereof, the audio source being the user's own voice, and the transmitting device being adapted to wirelessly transmit an audio signal comprising the user's own voice to said receiving device. This has the advantage that the receiving audio enhancement device, e.g. a hearing aid, of another listening person, which can be specifically 'tuned' to the reception of the voice of the wearer of the transmitting listening device, e.g. a microphone or a hearing aid.

In an embodiment, the transmitting device is an audio enhancement device as described above, in the detailed description of Thode(s) for carrying out the invention' and in the claims.

Use:

Use of an audio enhancement device or of an audio enhancement system as described above, in the detailed description of Thode(s) for carrying out the invention' and in the claims is moreover provided by the present invention. In an embodiment, use of an audio enhancement device in a device selected from the group of listening devices comprising a headset, an active earplug, a headphone, a hearing instrument and combinations thereof is provided. In an embodiment, use of an audio enhancement system in a public address system or a karaoke system is provided.

a Tangible Computer-Readable Medium:

A tangible computer-readable medium storing a computer program comprising program code means for causing a data processing system to perform at least some of the steps of the method described above, in the detailed description of Thode(s) for carrying out the invention' and in the claims, when said computer program is executed on the data processing system is furthermore provided by the present invention. In addition to being stored on a tangible medium such as diskette-, CD-ROM-, DVD-, or hard disk-media, or any other machine readable medium, the computer program can be transmitted via a transmission medium such as a wired or wireless link or a network, e.g. the Internet, and loaded into a data processing system for being executed at a location different from that of the tangible medium.

A Data Processing System:

A data processing system comprising a processor and program code means for causing the processor to perform at least some of the steps of the method described above, in the detailed description of Thode(s) for carrying out the invention' and in the claims is furthermore provided by the present invention.

Further objects of the invention are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The invention will be explained more fully below in connection with a preferred embodiment and with reference to the drawings in which.

The figures are schematic and simplified for clarity, and they just show details which are essential to the understanding of the invention, while other details are left out. Throughout, the same reference numerals or names are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

FIG. 1 shows embodiments of an audio enhancement system according to the invention comprising an audio source, a transmitter and one or more listening devices comprising an audio enhancement device according to the invention.

Figure 1A:
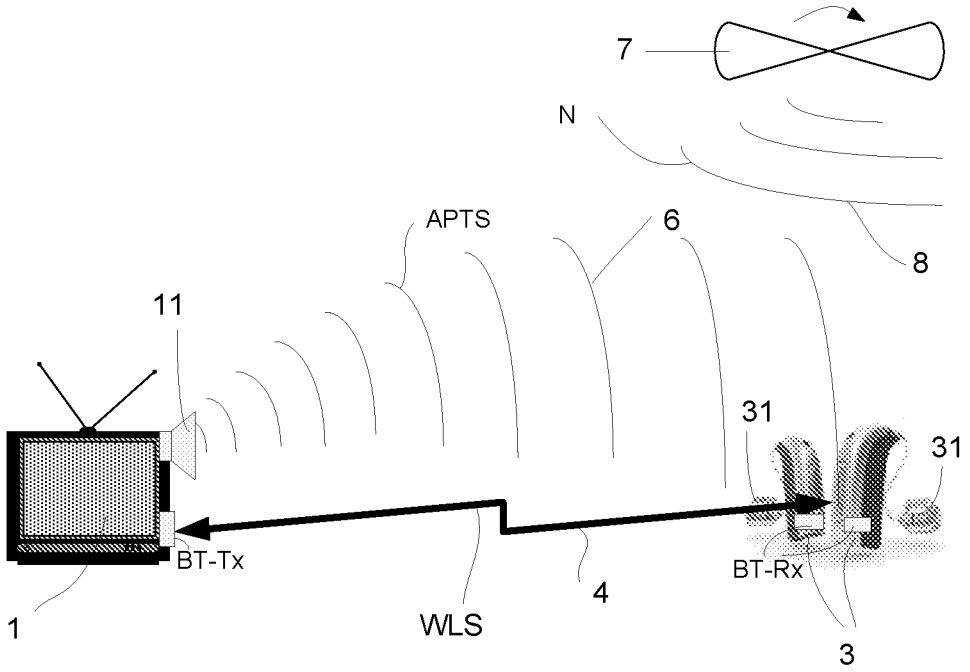
FIG. 1 shows embodiments of an audio enhancement system according to the invention comprising an audio source, a transmitter and one or more listening devices comprising an audio enhancement device according to the invention.

The audio enhancement system of FIG. 1*a* comprises a TV-set and a pair of listening devices, here a pair of hearing instruments of a binaural fitting. The TV-set 1 is provided with a loudspeaker for acoustically emitting a sound signal (APTS) 6 (a target signal, which a user wishes to receive) corresponding to the TV-images AND with a transmitter for transmitting the same sound (termed target audio signal) via a wireless link 4 in the form of signal WLS. In addition to the target signal 6, a noise signal (N) 8 (here produced by a fan 7, but representing all background noise (including other sound sources than the target sound) in the environment of the user) is mixed with the acoustically propagated target signal. Both signals are received by the pair of hearing instruments (HI) 3, each comprising an input transducer for converting the acoustically propagated sound signal(s) 6, 8 (APTS+N) to an electric input signal in the respective HIs, AND at least one of the HIs comprising a receiver for receiving the wirelessly transmitted signal (WLS) 4 and extracting a streamed target audio signal (which is typically not in phase with the acoustically propagated target signal). The wireless link can be based on a near-field coupling, e.g. an inductive coupling, between inductors of the TV-transmitter and the HI-receiver(s) or based on radiated (far-field) electromagnetic fields. The transmission can be based on analogue or digitally modulated signals. In the embodiment of FIG. 1*a*, a link based on radiated fields and operating according to the Bluetooth specification is anticipated (cf. transmitter BT-Tx of the TV-set and receiver BT-Rx of the hearing instrument(s)). A communication between the two hearing instruments allowing the exchange of control and/or status information and/or audio signals is preferably implemented. This wireless link can e.g. be based on near-field or far-field electromagnetic communication.

Various aspects of inductive communication are discussed e.g. in EP 1 107 472 A2 and US 2005/0110700 A1. WO 2005/055654 and WO 2005/053179 describe various aspects of a hearing aid comprising an induction coil for inductive communication with other units. US 2008/0013763 A1 describes a system for wireless audio transmission with a low delay from a transmission device (e.g. a TV-set) to a hearing device, e.g. based on radiated fields and Bluetooth. A wireless link protocol is e.g. described in US 2005/0255843 A1.

Figure 1B:
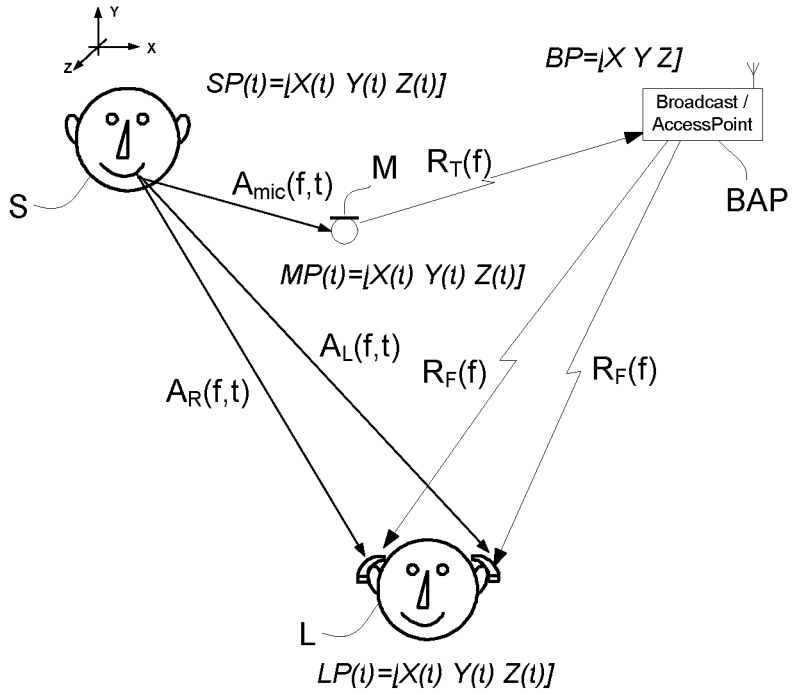

FIG. 1*b* shows an embodiment of an audio enhancement system comprising a wireless microphone M located at a variable position $MP(t)=[X_m(t), Y_m(t), Z_m(t)]$ (t being time, and X, Y, Z being the coordinates of the position in an xyz-coordinate system) for picking up the voice (mixed with possible noise in the environment of the microphone) of a speaker S located at a variable position $SP(t)=[X_s(t), Y_s(t), Z_s(t)]$, the wireless microphone being adapted to wirelessly transmit the picked up target signal. The system may further comprise a broadcast access point BAP located at a fixed position $BP=[X_{bp}, Y_{bp}, Z_{bp}]$, and adapted for relaying the radio signal from the wireless microphone. The system additionally comprises a pair of listening devices (e.g. hearing aids) worn at the ears of a listener L located at a variable position $LP(t)=[X_l(t), Y_l(t), Z_l(t)]$ and adapted to receive the wirelessly transmitted (audio) signal from the wireless microphone (e.g. via the broadcast access point) as well as the directly propagated audio signal from the speaker (mixed with possible other sounds and acoustic noise from the surroundings of the user). $A_R(f,t)$, $A_L(f,t)$, $A_{mic}(f,t)$ represent acoustic transfer functions from the speaker to the Right hearing instrument, to the Left hearing instrument and to the wireless microphone, respectively. The acoustic transfer functions A(f,t) are dependent on frequency f and time t. The acoustic propagation delay in air is around 3 ms/m (i.e. propagation path of 10 m's length induces a delay of around 30 ms in the acoustically propagated signal). $R_T(f)$ and $R_F(f)$ represent radio transfer functions from the wireless microphone to the broadcast access point and from the broadcast access point to the hearing instruments, respectively (assumed equal for the two left and right HI-positions). The radio transfer functions R(f) are dependent on frequency f but assumed independent of time.

Figure 1C:
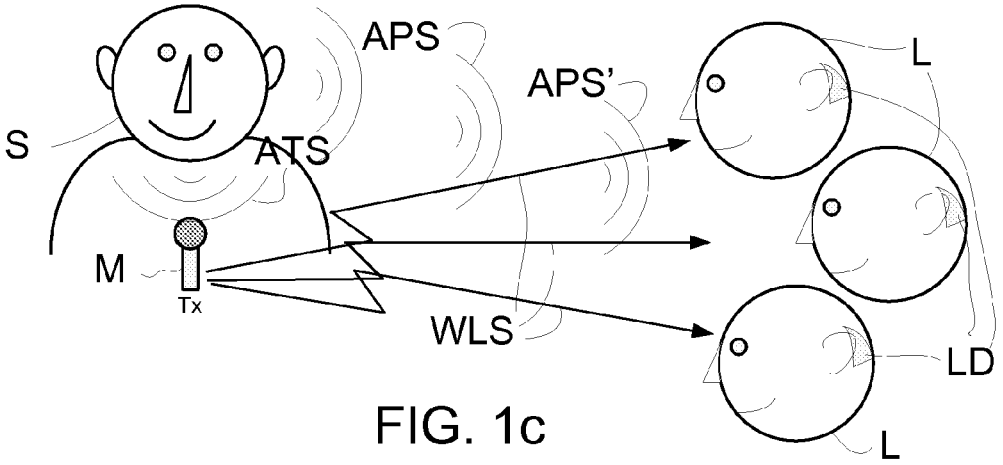

FIG. 1*c* illustrates an application of an audio enhancement system in a small group comprising a speaker S speaking a target signal into a microphone M (here a wireless microphone) comprising a transmitter Tx for wirelessly transmitting a signal WLS comprising the electrical target audio signal picked up by the microphone to one or more listeners L (here three are shown) wearing a listening device LD at one or both ears. The spoken target signal ATS is acoustically propagated to the listeners (and typically distorted, attenuated and mixed with other sounds along the path to the listener(s), as indicated by signals APS, APS'). The listening device LD comprises an audio enhancement device for estimating the target signal from the acoustically propagated electric signal and the streamed target audio signal using an adaptive system.

Figure 1D:
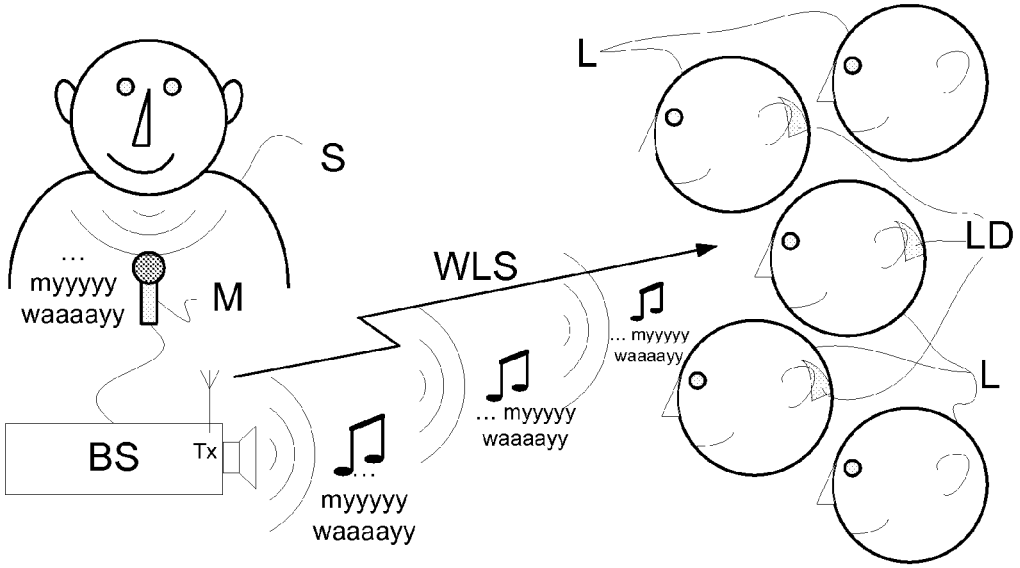

FIG. 1*d* illustrates an application of an audio enhancement system in a public address system, e.g. in a class room or auditorium or entertainment application (e.g. karaoke), where a speaker S (e.g. a teacher) speaks or sings a target signal (myyyyy waaaayy) into a microphone M (e.g. a wireless microphone, here a wired microphone is shown) in communication with a base station BS comprising circuitry for driving a loudspeaker (and possibly adding music or other sounds to the signal) for acoustically propagating the resulting signal to one or more listeners L (the signal being typically distorted, attenuated and mixed with other sounds along the path to the listener(s) as indicated by the diminishing character size in myyyyy waaaayy). The base station further comprises a transmitter Tx for wirelessly transmitting a signal WLS comprising the electrical target audio signal picked up by the microphone (and possibly added sounds, e.g. accompanying music) to one or more listeners L wearing a listening device at one or both ears (here three are shown wearing listening devices LD and two listeners are shown only receiving the acoustically propagated signal). The listening devices comprise an audio enhancement device for estimating the target signal from the acoustically propagated electric signal and the streamed target audio signal using an adaptive system.

FIG. 2 shows block diagrams of various audio enhancement devices according to embodiments of the invention.

The embodiments of FIGS. 2*a*, 2*b*, 2*c*, 2*d*, 2*e*, 2*f*, 2*g*, 2*h* and 2*i* each comprise a receiver of a wireless signal comprising an antenna, an amplifier and a demodulator adapted for extracting a target audio signal (termed the streamed target audio signal) from the wirelessly received signal. The receiver of a wireless signal may additionally comprise analogue to digital (AD) converter and/or time to frequency (t->f) conversion units (cf. e.g. filter bank unit FB in FIGS. 2*h*, 2*i*). The audio enhancement device further comprises at least one microphone (in the embodiments of FIGS. 2*a*, 2*b*, 2*c*, 2*d*, 2*e* and 2*f* one microphone is indicated, whereas the embodiment in FIG. 2*g* comprises a multitude of microphones $m_1, \ldots, m_n$) for converting an input sound to an electrical input signal, the input sound e.g. comprising a mixture of a target signal from an acoustic source and noise signals from the environment (termed the propagated electric signal). The microphone(s) may additionally comprise analogue to digital converting units and/or a time to frequency conversion units (or such units may be implemented elsewhere in the audio enhancement device depending on practical circumstances, cf. e.g. filter banks FB in FIG. 2*h*, 2*i*).

Figure 2A:
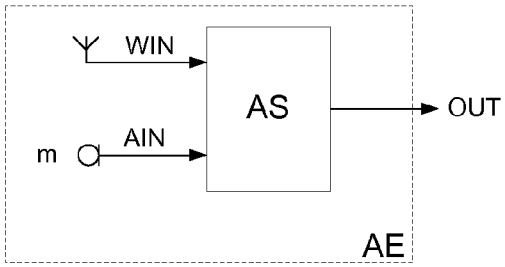
FIG. 2 shows block diagrams of various audio enhancement devices according to embodiments of the invention.

In the most general embodiment of FIG. 2*a*, the audio enhancement device (AE in FIG. 2*a*)—in a addition to the receiver circuitry for receiving the acoustically and wirelessly propagated signals—further comprises an audio enhancement unit (AS in FIG. 2*a*) receiving as inputs the streamed target audio signal comprising the target audio signal and the acoustically propagated signal, the audio enhancement unit comprising an adaptive system (e.g. an adaptive filter) adapted for estimating the target signal from the propagated electric signal and the streamed target audio signal and providing an enhanced target signal as an output (OUT in FIG. 2*a*). The output can e.g. be further processed in a signal processing unit (e.g. introducing user specific processing to adapt the signal to a particular user's hearing needs).

In the embodiments of FIGS. 2*b*, 2*c*, 2*d*, 2*e* and 2*g*, the audio enhancement unit (AS in FIG. 2*a*) comprises an estimator unit (E in FIG. 2*b*, 2*c*, 2*d*, 2*e* and ESTIMATOR in FIG. 2*g*) and an actuator unit (A in FIG. 2*b*, 2*c*, 2*d*, 2*e* and ACTUATOR in FIG. 2*g*), one unit taking the propagated electric signal as a first input, the other taking the streamed target audio signal as a first input. The estimator unit is adapted for extracting characteristics of the input signal(s)

and providing a control output comprising such characteristics as a second input to the actuator unit. The actuator unit is adapted for providing as an output (OUT) an estimate of the target signal based on its first and second inputs. In the embodiments of FIGS. 2*b*, 2*c*, 2*d*, 2*e* and 2*g*, the enhanced target signal as an output (OUT) of the actuator unit is fed to the estimator unit and used in the extraction of said characteristics.

Figure 2B:
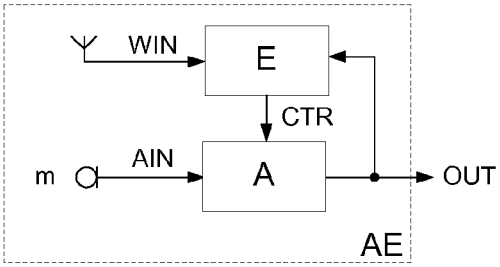
Figure 2C:
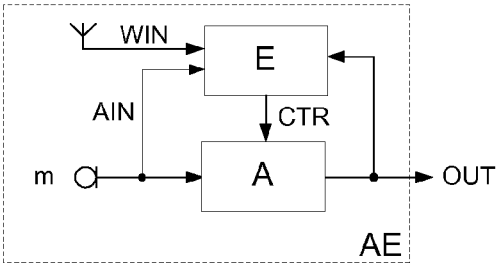

FIGS. 2*b* and 2*c* illustrates embodiments, where the target signal is estimated based on the acoustically propagated signal (propagated electric signal) using the streamed target audio signal to extract characteristics of the target signal. In the embodiment of FIG. 2*c*, the propagated electric input signal to the actuator unit is additionally fed to the estimator unit and used in the extraction of the characteristics of the target signal.

Figure 2D:
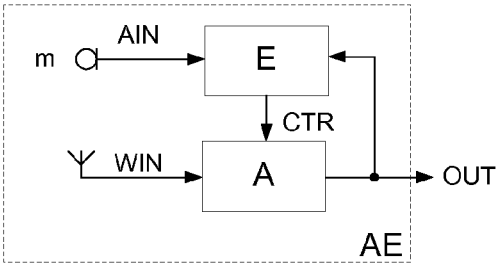
Figure 2E:
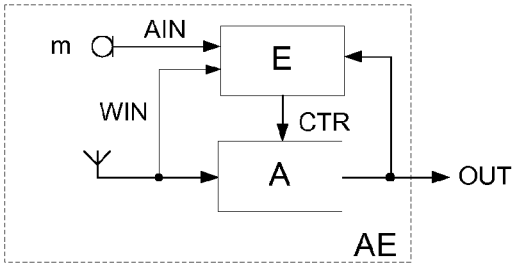

FIGS. 2*d* and 2*e* illustrates embodiments where the target signal is estimated based on the electromagnetically propagated signal (the streamed target audio signal) using the acoustically propagated electric signal to extract characteristics of the propagation path (room characteristics, distance, head related transfer functions, etc.). In the embodiment of FIG. 2*e*, the streamed target audio input signal to the actuator unit is additionally fed to the estimator unit and used in the extraction of the characteristics of the target signal (e.g. concerning the influence of the room).

Figure 2F:
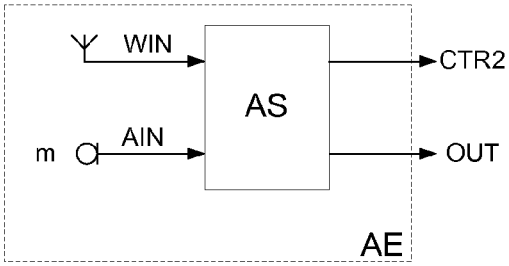

FIG. 2*f* shows an embodiment of an audio enhancement device as in FIG. 2*a*, additionally comprising a control output signal CTR2 comprising characteristics of the target signal extracted from the streamed target audio input signal and/or from the propagated electric signal e.g. for use as an input to other processing algorithms further down the forward path of the estimated target signal, e.g. for adapting the target signal to a user's hearing profile e.g. of a communication device, such as a mobile telephone or a listening device, such as a hearing instrument.

Figure 2G:
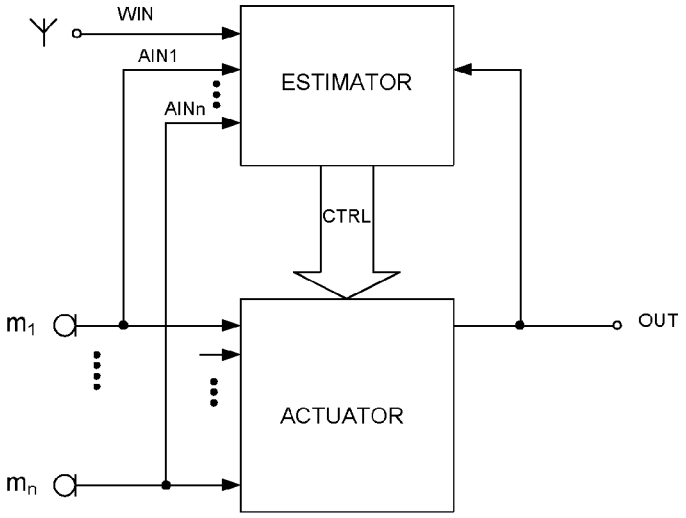

FIG. 2*g* shows an embodiment of an audio enhancement device comprising a multitude of microphones where the target signal is estimated based on the acoustically propagated signal (propagated electric signal). The audio enhancement device comprises an ESTIMATOR unit for extracting characteristics (a model) of a target signal from the wirelessly received target audio signal WIN. Additionally, the electrical input signal(s) AIN1, AIN2, . . . , AINn from the microphones $m_1, \ldots, m_n$, and the estimate of the target signal OUT are fed to the ESTIMATOR unit as inputs. The ESTIMATOR unit provides as an output a control signal CTRL indicative of characteristics of the target signal. The audio enhancement device further comprises an ACTUATOR unit for adapting the electrical input signals from microphones $m_1, \ldots, m_n$ to provide as an output OUT an estimate of the target signal based on the electrical input signals from microphones and the control signal(s) CTRL from the ESTIMATOR unit. The output OUT is fed back to the ESTIMATOR unit and used in the determination of the control signal output CTRL. The output OUT of the ACTAUTOR unit is e.g. used as an input to a signal processing unit for further signal processing relevant for the device in question which the audio enhancement device forms part of, e.g. a listening device, such as a hearing aid. Further signal processing may e.g. include adapting the signal to a user's specific needs (e.g. applying a frequency dependent gain, compression, feedback cancellation, etc.). Other possible devices hosting an audio enhancement device according to the invention are a headset, an active earplug, a pair of headphones, an ASR (Automatic Speech Recognition) system, etc.

Figure 2H:
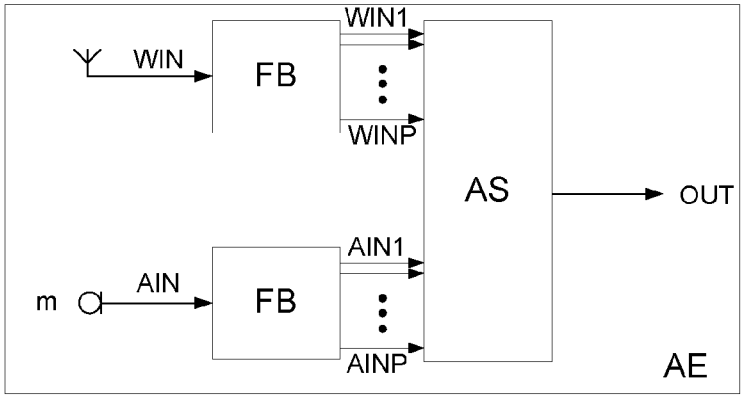
Figure 2I:
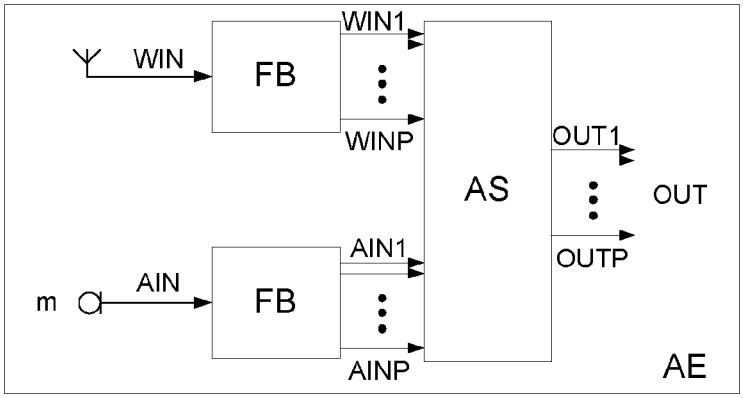

FIGS. 2*h* and 2*i* show embodiments of an audio enhancement device where the acoustically and wirelessly propagated input signals are processed in the frequency domain. In both embodiments, the streamed target audio signal WIN and the propagated electric signal AIN are fed to respective filter banks FB for splitting the input signals in a number of signals each representing a part of the frequency range of the input signal. FIG. 2*h* shows an embodiment where the output OUT from the AS unit representing the estimate of the target signal is synthesized to one (time dependent) signal e.g. for being presented to a user via an output transducer, whereas FIG. 2*i* provides the estimate of the target signal OUT from the AS unit in the (time) frequency domain.

Figure 3A:
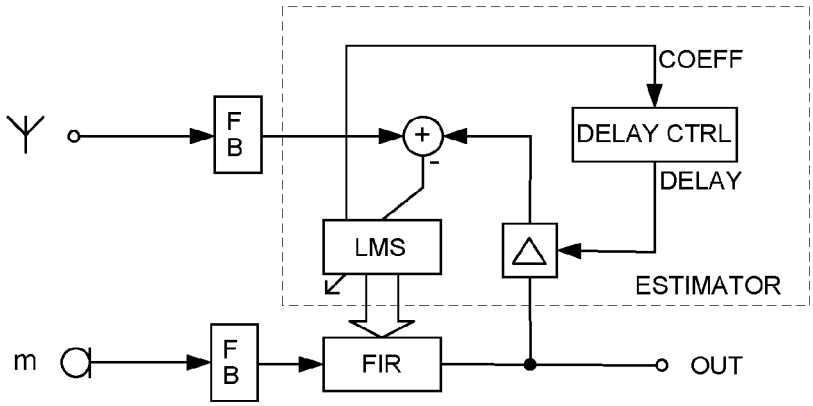
FIG. 3 shows block diagrams of two embodiments of an audio enhancement device according to the invention, FIG. 3*a* showing a single-microphone device and FIG. 3*b* showing a multi-microphone device.
Figure 3B:
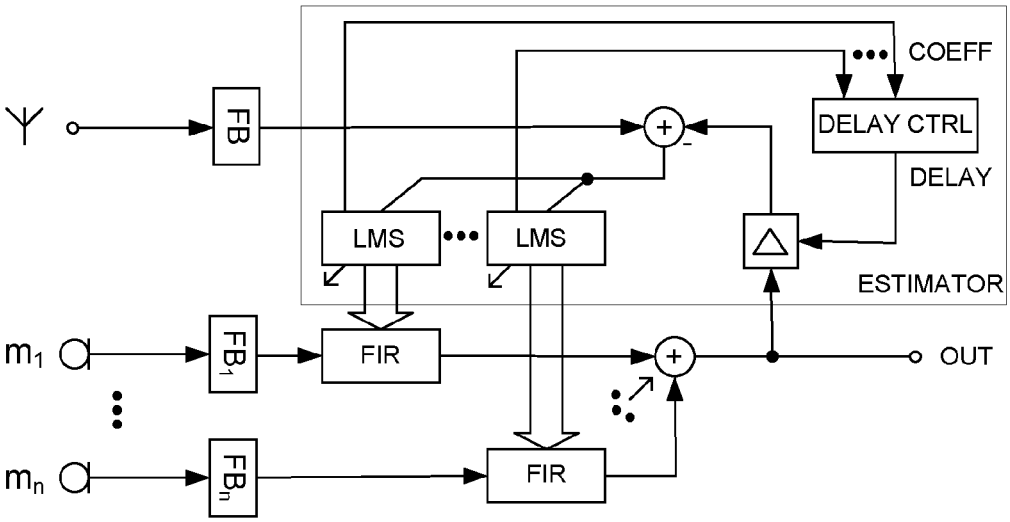

FIG. 3 illustrates two embodiments of the invention implementing an audio enhancement device. The audio enhancement device comprises a wireless receiver in the form of an antenna and corresponding electronic circuitry adapted for picking up a wirelessly transmitted signal comprising an audio signal and demodulating it to an electrical signal representing the wirelessly received (target) audio signal transmitted (e.g. streamed) from an entertainment device, e.g. a PC or a TV-set. The acoustic signal comprising the target signal, e.g. the sound from a PC or a TV-set or a voice from a speaker or singer, and other (possibly unwanted) sources of sound or noise in the environment is picked up by a (e.g. directional) microphone system of the audio enhancement device (the embodiment of FIG. 3*a* comprising a single microphone m, the embodiment of FIG. 3*b* comprising a multitude of microphones $m_1, m_2, \ldots m_n$). The electric input signal(s) from the microphone m (FIG. 3*a*) or the multitude of microphones $m_1, m_2, \ldots m_n$ (FIG. 3*b*) is(are) fed to corresponding filter banks FB (FIG. 3*a*) and $FB_1, FB_2, \ldots, FB_n$ (FIG. 3*b*), respectively, for converting the time variant electric input signal(s) to the (time-) frequency domain. Instead of filter banks, any other time to frequency conversion elements (e.g. Fourier Transform algorithms, such as FFT) may be used, if appropriate. The outputs from the filter bank(s) connected to the microphone(s) is(are) fed to each their adaptive filters (FIR, LMS) for estimating the target signal (here a FIR-filter with an LMS algorithm is indicated; other filters (e.g. IIR) and algorithms (e.g. RLS) may be used). The wirelessly received, 'clean' version of the target signal is fed to a filter bank FB for conversion to the (time-) frequency domain. Depending on the actual acoustic propagation distance in the room in question, the delay of the input transducer and associated circuitry and the delay of units for possible coding, error correction, etc., and on the transmission- and reception-delays of the wirelessly transmitted signal, either of the two signal paths may have the larger propagation delay from the acoustic source to the audio device (cf. e.g. FIG. 1*b* for an example of an acoustic and an electromagnetic propagation path). In the embodiment of FIG. 3, it is assumed that the wirelessly transmitted signal is delayed more than the acoustically transmitted signal. The amount of delay between the streamed signal and the acoustically received signal is estimated and controlled by a delay control unit (DELAY CTRL) receiving copies of the filter coefficients (COEFF) from the algorithm part(s) (LMS) of the adaptive filter(s) (FIR, LMS). The delay control unit may e.g. be implemented by an adaptive filter. The estimated target signal OUT is in the embodiment of FIG. 3*a* the output of the single variable filter part (FIR) of the single adaptive filter (FIR, LMS) and in the embodiment of FIG. 3*b* the output of multi input SUM unit ('+' in FIG. 3*b*) providing a (possibly weighted) sum of the outputs of the multitude of variable filter parts (FIR) of the multitude of adaptive filters (FIR, LMS). The estimated target signal OUT is e.g. fed to a signal processor (e.g. for further processing of the signal, such as applying a frequency dependent gain according to a user's needs, compression, noise reduction, etc.) and is further branched off to a delay unit (Δ), which delays the estimated target signal (OUT) by an estimated delay controlled by the output (DELAY) of the delay control unit (DELAY CTRL), The output of the delay unit (Δ) is subtracted (in SUM unit '+') from the wirelessly received (streamed) target signal. The delay unit can be implemented as variable delay line or as a programmable wait routine in a software algorithm. The resulting signal is fed to the algorithm part (LMS) of the adaptive filters (the multitude if algorithm parts (LMS) in the embodiment of FIG. 3*b*) and used to determine (update) the filter coefficients of the adaptive filter. Thereby the wirelessly received (streamed) target signal is used to estimate the target signal extracted from the acoustically received signal and the delay problem is eliminated. The dashed (FIG. 3*a*), respectively solid (FIG. 3*b*), line enclosing units LMS, Δ, DELAY CTRL and a SUM-unit '+' indicates elements of the ESTIMATOR units of FIG. 2*b*-2*e*, 2*g*. The variable filter part(s) (FIR) of the adaptive filter(s) (LMS, FIR) (and the sum unit '+' in FIG. 3*b* connected to the outputs of the variable filter parts) represent(s) the ACTUATOR unit of FIG. 2*b*-2*e*, 2*g*.

The proposed scheme can be used to correct or re-establish the audio characteristics ('audio fingerprints') of the received acoustic signal in accordance with the target signal, e.g. spectral, temporal and modulation characteristics (such as pitch, onset, offset, cepstral coefficients, MFCC (Mel Frequency Cepstral Coefficients, etc.). Further, the proposed scheme can be used to compensate for non-linearities in loudspeakers in a room (so that the resulting version of the sound signal is NOT 'destroyed' by bad components). Such characteristics can e.g. be extracted from the wirelessly received target signal (possibly in combination with corresponding characteristics extracted from the propagated electric signal) in the ESTIMATOR unit and applied to the estimate of the target signal in the ACTUATOR unit by means of control signals CTR (cf. e.g. FIG. 2*b*, 2*c*, 2*g*, 3).

Figure 4:
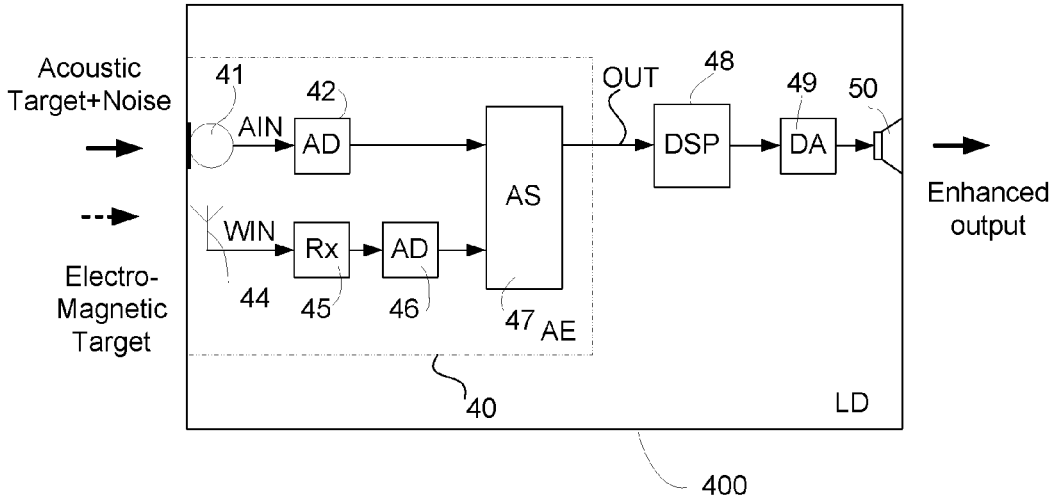
FIG. 4 shows a listening device comprising an audio enhancement device according to an embodiment of the invention.

FIG. 4 shows a listening device comprising an audio enhancement device according to an embodiment of the invention. The listening device 400 (LD), e.g. a hearing instrument, comprises an audio enhancement device (AE) 40 (enclosed by the dotted rectangle), a signal processing unit (DSP) 48, a digital to analogue converter (DA) 49 and an output transducer 50 (here a receiver). The audio enhancement device 40 comprises a microphone system 41 (depicted as a single microphone but in practice possibly comprising a multitude of microphones) for converting an input sound comprising a target sound and a noise signal (cf. Acoustic Target+Noise in FIG. 4) to an (propagated) electric input signal AIN comprising said target signal and said noise signal, an analogue to digital converter (AD) 42 for providing a digitized electric input signal comprising said target signal and said noise signal. The digitized electric input signal is fed to the audio enhancement unit (AS) 47, as e.g. depicted in more detail in FIG. 2*b*-2*e*, 2*g* and 3*a*-3*b* (comprising the ESTIMATOR and ACTUATOR blocks in FIG. 2 and their equivalents in FIG. 3). The audio enhancement device 40 further comprises a wireless receiver (comprising antenna 44 and receiver unit (Rx) 45) for receiving a signal (cf. ElectroMagnetic Target in FIG. 4) comprising the target audio signal and for extracting said (streamed) target audio signal. The target audio signal is digitized in analogue to digital converter (AD) 46. The digitized output of the AD-converter comprising the wirelessly received target audio signal is fed to the audio enhancement unit (AS) 47. The signal processing unit 48 (DSP) is adapted to process the output signal OUT from the audio enhancement unit (AS), e.g. to adapt the signal to a specific user's hearing profile (including applying a frequency dependent gain). The signal from the signal processing unit 48 is connected to the DA-converter 49, whose analogue output is fed to the receiver 50 for presenting an Enhanced output to a user. The hearing instrument may further comprise other circuitry for improving the signal presented to the user, e.g. an anti-feedback system.

Figure 5:
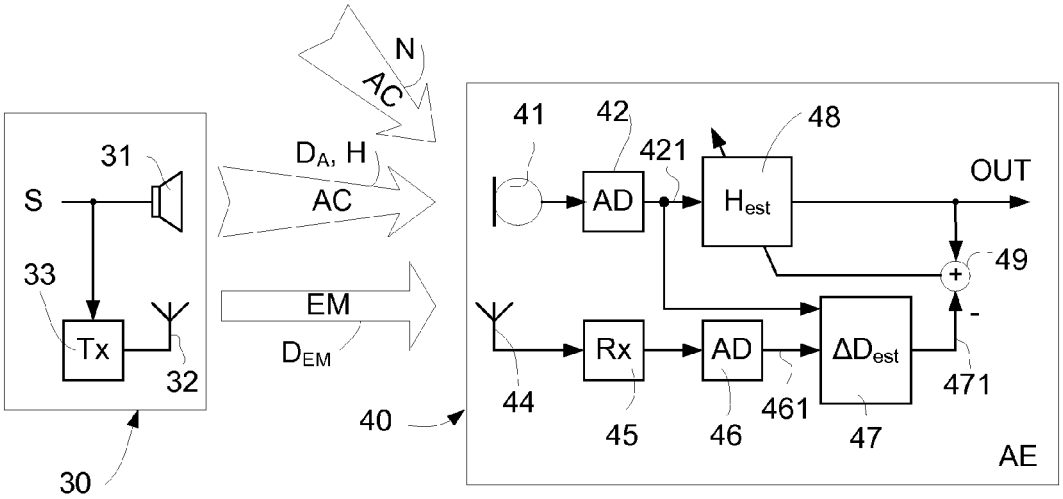
FIG. 5 shows an example of an audio enhancement system according to an embodiment of the invention, the system comprising an audio enhancement device wherein the target signal is estimated based on the acoustically propagated signal based on LMS deconvolution.

FIG. 5 shows an example of an audio enhancement system according to an embodiment of the invention, the system comprising an audio enhancement device wherein the target signal is estimated based on the acoustically propagated signal based on LMS deconvolution. The embodiment of an audio enhancement system shown in FIG. 5 entertainment device 30 comprising an audio source (comprising electrical target signal S and speaker 31 for converting the target signal S to an acoustic target signal), and a transmitting device (comprising transmitter (Tx) 33 and antenna 32) for generating a wireless signal comprising a representation of the target signal in the form of a target audio signal. The audio enhancement system further comprises a receiving device 40 comprising an audio enhancement device (AE). The acoustic target signal generated by the speaker 31 follows an acoustic propagation path (cf. arrow denoted AC $D_A$, H in FIG. 5) from the speaker 31 to the microphone 41 of the audio enhancement device 40. Along the acoustic propagation path, the acoustically propagated target signal is modified, including being delayed by an amount $D_A$ and subject to a (typically frequency dependent) transfer function H. Also other acoustic source signals in the environment are added along the acoustic propagation path (cf. arrow denoted AC N) in FIG. 5. Likewise, the wireless signal generated by the transmitter 33, 32 follows an electromagnetic propagation path (cf. arrow denoted EM $D_{EM}$ in FIG. 5) from the transmitter (33, 32) of the entertainment device 30 to the receiver (44, 45) of the audio enhancement device 40. The audio enhancement device comprises a microphone system 41 for converting the acoustically propagated signal from the speaker 31 to an electric input signal and an AD-converter 42 for sampling the electric input signal and providing a digitized input signal 421, which is fed to an adaptive system 48 ($H_{est}$), e.g. an adaptive filter, for providing as an output OUT an estimate of the target signal. The audio enhancement device 40 further comprises a wireless receiver (comprising antenna 44 and receiver unit (Rx) 45) for receiving a signal comprising the target audio signal and for extracting said (streamed) target audio signal. The target audio signal is digitized in analogue to digital converter (AD) 46, whose output the digitized streamed target audio signal 461 is fed to a delay estimate unit 47 ($\Delta D_{est}$) together with the digitized propagated electric signal 421, the delay estimate unit 47 being adapted for estimating the difference ($D_A$–$D_{EM}$) in delay between the two input signals and providing as an output 471 a digitized streamed target audio signal delayed by $D_A$–$D_{EM}$ (here $D_A$ is assumed to be larger than $D_{EM}$; if this is not the case, the order of the delays should be reversed). The delayed digitized streamed target audio signal 471 is subtracted from the estimate of the target signal OUT in SUM unit 49 (+). The resulting signal is used in the adaptive system 48 ($H_{est}$) for estimating the acoustic propagation path H resulting in a transfer function providing an estimate of $H^{-1}$ ($H_{est}^{-1}$). The wirelessly propagated signal received at the receiver is delayed by $D_{EM}$ ($D_{EM}$ possibly including delays in Tx, Rx, and AD units) and can be written as $S \cdot z^{-D_{EM}}$. The acoustically propagated signal picked up by the microphone 41 can be written as $S \cdot z^{-D_A} \cdot H + N$ ($D_A$ possibly including delays in microphone and AD-conversion units). The delay estimate unit 47 ($\Delta D_{est}$) estimates the delay difference ($D_A - D_{EM}$) providing the transfer function $z^{-(D_A - D_{EM})}$ resulting in an output signal 471 of the $\Delta D_{est}$ unit of the form $S \cdot z^{-D_A}$. The delay difference ($D_A - D_{EM}$) may e.g. be determined by considering the cross correlation between the two input signals. The resulting output OUT of the adaptive system 48 can thus be written as $S \cdot z^{-D_A} \cdot H \cdot H_{est}^{-1} + N \cdot H_{est}^{-1}$. If $H_{est}$ is a good estimate of H, the output OUT ($OUT = S \cdot z^{-D_A} + N \cdot H_{est}^{-1}$) of the signal enhancement unit comprises the estimate of the target signal plus a noise contribution coloured by the estimate $H_{est}$ of the acoustic propagation path (comprising contributions from the environment, e.g. reflections of a room and its contents, the loudspeaker 31, the microphone 41, etc.). The smaller the noise contribution N, the better the target signal estimate. If a noise component $N_i$ contributing to the total noise N is constant (or periodic), e.g. originating from a fan, a dish washing machine or the like, such contribution may be filtered out, thereby improving the target signal estimate.

Figure 6:
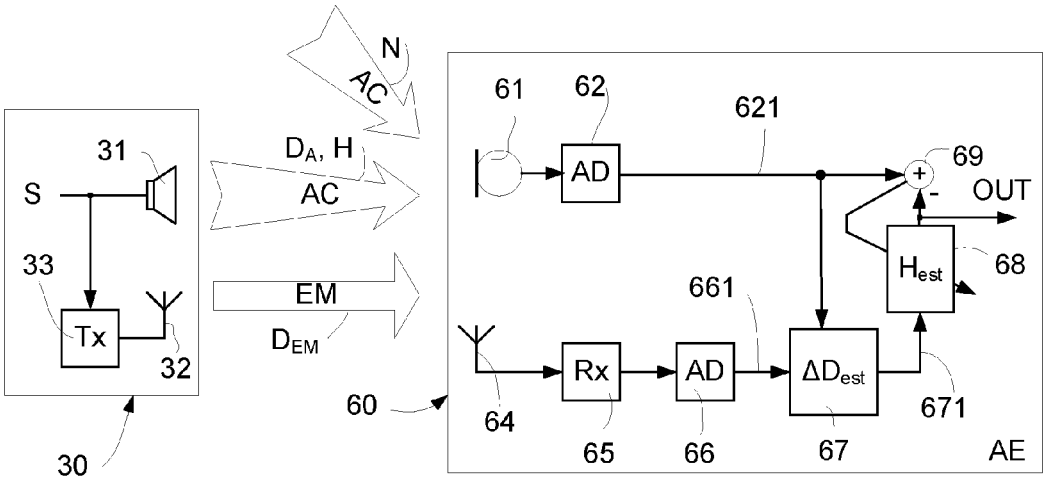
FIG. 6 shows an audio enhancement system according to an embodiment of the invention, the system comprising an audio enhancement device wherein the target signal is estimated based on the electromagnetically propagated signal.

FIG. 6 shows an audio enhancement system according to an embodiment of the invention, the system comprising an audio enhancement device wherein the target signal is estimated based on the electromagnetically propagated signal. The embodiment of an audio enhancement system of FIG. 6 resembles the embodiment of FIG. 5. The roles of the acoustically and wirelessly propagated signals in the estimation of the target signal are, however, switched. The entertainment device 30 (e.g. an NV-device, such as a TV) and the propagation scenario is assumed to be equivalent to that of FIG. 5. In the following, only the receiving device 60 comprising an audio enhancement device (AE) is described. The audio enhancement device (AE) comprises a microphone system 61 for converting the acoustically propagated signal from the speaker 31 to an electric input signal and an AD-converter 62 for sampling the electric input signal and providing a digitized input signal 621, which is fed to a delay estimate unit 67 ($\Delta D_{est}$) as well as to SUM unit 69 ('+). The audio enhancement device 60 further comprises a wireless receiver (comprising antenna 64 and receiver unit (Rx) 65) for receiving a signal comprising the target audio signal and for extracting said (streamed) target audio signal. The target audio signal is digitized in analogue to digital converter (AD) 66, whose output the digitized streamed target audio signal 661 is fed to the delay estimate unit 67 ($\Delta D_{est}$) together with the digitized propagated electric signal 621, the delay estimate unit 67 being adapted for estimating the difference ($D_A - D_{EM}$) in delay between the two input signals and providing as an output 671 a digitized streamed target audio signal delayed by $D_A - D_{EM}$ (here $D_A$ is assumed to be larger than $D_{EM}$; if this is not the case, the order of the delays should be reversed). The delayed digitized streamed target audio signal 671 is fed to an adaptive system 68 ($H_{est}$) for providing as an output OUT an estimate of the target signal. The output OUT of the adaptive system (e.g. an adaptive filter, e.g. a FIR filter) is subtracted from the digitized propagated electric signal 621 in SUM unit 69 (+). The resulting signal is used in the adaptive system 68 ($H_{est}$), e.g. implemented using an adaptive filter, for estimating the acoustic propagation path H resulting in a transfer function providing an estimate of H ($H_{est}$). The wirelessly propagated signal received at the receiver is delayed by $D_{EM}$ ($D_{EM}$ possibly including delays in Tx, Rx, and AD units) and can be written as $S \cdot z^{-D_{EM}}$. The acoustically propagated signal picked up by the microphone 61 can be written as $S \cdot z^{-D_A} \cdot H + N$ ($D_A$ possibly including delays in microphone and AD-conversion units). The delay estimate unit 67 ($\Delta D_{est}$) estimates the delay difference ($D_A - D_{EM}$) providing the transfer function $z^{-(D_A - D_{EM})}$ resulting in an output signal 671 of the $\Delta D_{est}$ unit of the form $S \cdot z^{-D_A}$. The delay difference ($D_A - D_{EM}$) may e.g. be determined by considering the cross correlation between the two input signals. The output of the SUM unit 69 used for estimating the acoustic propagation path H in the adaptive system 68 can be written as $S \cdot z^{-D_A} \cdot H + N - S \cdot z^{-D_A} \cdot H_{est}$. The resulting output OUT of the adaptive system 68 can be written as $OUT = S \cdot z^{-D_A} \cdot H_{est}$. If $H_{est}$ is a good estimate of H, the output OUT of the signal enhancement unit comprises the estimate of the target signal coloured by the estimate $H_{est}$ of the acoustic propagation path (comprising contributions from the environment, e.g. reflections of a room and its contents, head-related transfer functions HRTF, the loudspeaker 31, the microphone 41, etc.). The colouring of the otherwise 'clean', wirelessly transmitted target signal can e.g. be of interest in specific situations. In a preferred embodiment, the above described way of estimating the target signal based on the wirelessly propagated signal is used in specific listening situations, where an impression of the room or other acoustic environment (e.g. a concert situation) is of importance, is e.g. implemented in a specific program of a listening device, e.g. a hearing instrument, such program being e.g. adapted to be switched on and off by the user. In an embodiment comprising two listening devices, one located at or in each ear of a user, the above scheme provides the possibility to implement individualized HRTFs. In an embodiment, the adaptive system 68 ($H_{est}$) for estimating the acoustic propagation path H comprises an adaptive filter of an order higher than 60, such as higher than 120, such as higher than 240.

Figure 7A:
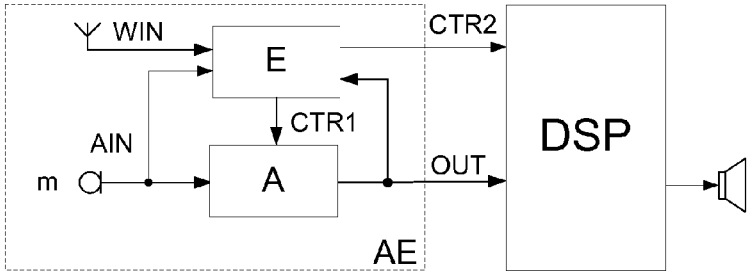
FIG. 7 shows block diagrams of two embodiments of a listening device according to the invention.
Figure 7B:
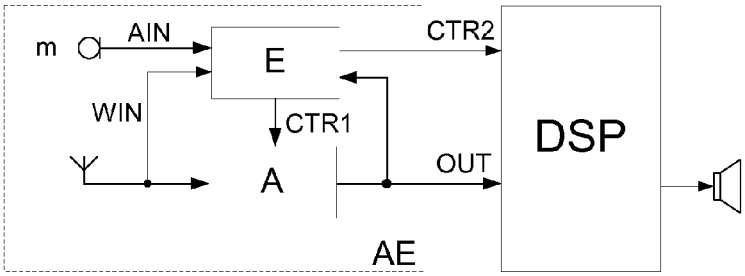

FIG. 7 shows block diagrams of two embodiments of a listening device according to the invention, the listening devices comprising and audio enhancement device (AE) electrically connected to a signal processing unit (DSP) and a speaker/receiver, said devices comprising a forward path for a target audio signal. The embodiments of the audio enhancement device (AE) of FIGS. 7*a* and 7*b* comprise the same elements as the embodiments shown in FIGS. 2*b* and 2*c*, respectively. Additionally, the embodiments of an audio enhancement device (AE) of FIGS. 7*a* and 7*b* comprise (as in FIG. 2*f*) an output signal CTR2 comprising characteristics of the target signal extracted from the streamed target audio input signal and/or from the propagated electric signal for use as an input to the signal processing unit (DSP). FIG. 7*a* shows an embodiment where the target signal is estimated based on the acoustically propagated signal (AIN) and characteristics of the target signal are extracted from the electromagnetically propagated signal (WIN) and used (signal CTR1) in the estimate of the target signal OUT. FIG. 7*b* shows an embodiment where the target signal is estimated based on the electromagnetically propagated signal (WIN) and characteristics of the target signal are extracted from the acoustically propagated signal (AIN) and used (signal CTR1) in the estimate of the target signal OUT. The listening devices of FIG. 7 may form part of a communication device, such as a mobile telephone or a listening device, such as a hearing instrument. In an embodiment, digital processing parts of the audio enhancement unit (AE), e.g. the estimator (E) and actuator (A) units, form part of a digital signal processor. In an embodiment, some or all of the functions of the estimator (E) and actuator (A) units are implemented as software algorithms.

Figure 8:
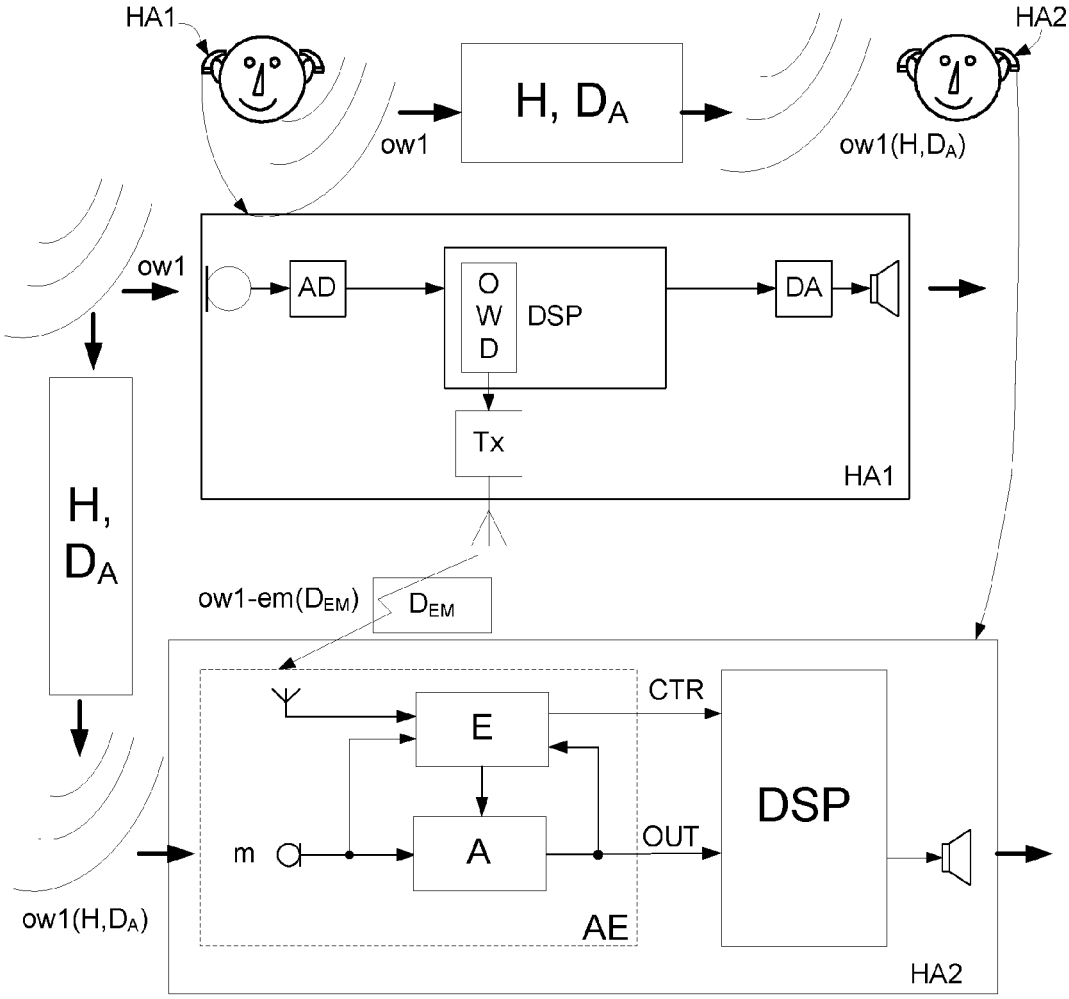
FIG. 8 shows an audio enhancement system adapted for enhancement of a particular voice according to an embodiment of the invention.

FIG. 8 shows an audio enhancement system adapted for enhancement of a particular voice according to an embodiment of the invention. The embodiment of an audio enhancement system shown in FIG. 8 comprises at least two listening devices, e.g. hearing instruments (or pairs of listening devices, e.g. hearing instruments), a first device HA1 being worn by a first user whose voice is acting as an audio source for generating an acoustic target signal ow1 and, the first device HA1 comprising a transmitting device (Tx and antenna in HA1) for generating a wireless signal ow1-em ($D_{EM}$) comprising a representation of said target signal ow1 in the form of a streamed target audio signal. The audio enhancement system further comprises a second listening device HA2 (cf. e.g. described in connection with FIG. 7*a*) worn by a second user and comprising an audio enhancement device comprising a receiving device (antenna in HA2 and other receive and demodulation circuitry, not shown). The acoustic propagation path from the acoustic source of the target signal ow1 (user one) to the listening device HA2 worn by user 2 is characterized by transfer function H and delay $D_A$ resulting in signal ow1(H, $D_A$) received by HA2 (here neglecting possible noise N added to the acoustic signal). The transmitting device HA1 comprises a microphone for picking up an input sound, here a user's voice ow1 and converting the input sound to an analogue electric input signal, which is digitized in an analogue to digital converter AD whose digitized output is fed to a processing unit DSP comprising an own voice detector OWD for detecting and extracting a user's own voice (this can e.g. be implemented as described in WO 2004/077090 A1 or in EP 1 956 589 A1). A signal comprising the user's own voice (or characteristics thereof) is fed to a transmitter Tx and wirelessly transmitted to the receiving device HA2 (via antennas of the transmitting and receiving devices). The wireless propagation path of the target signal ow1-em from the transmitting device HA1 to the receiving device HA2 is characterized by a delay $D_{EM}$, resulting in signal ow1-em($D_{EM}$) being received by HA2. The audio enhancement unit AE of HA2 is adapted to estimate the target signal ow1 (the voice of user 1) based on the received wirelessly streamed signal ow1-em($D_{EM}$) (as e.g. described in connection with FIG. 5), whereby the output signal OUT of the audio enhancement unit of HA2 comprises an enhanced version of the acoustically propagated voice of user 1 (target signal). The estimated target signal (OUT) is fed to a signal processing unit DSP for possible further processing of the signal and eventual presentation of an enhanced (user adapted) output signal to user 2 via an output transducer (here a receiver). A further signal CTR from the audio enhancement unit comprising characteristics of the target signal is fed to the signal processing unit and used in the further processing of the estimated target signal (OUT). The forward path of the listening device HA1 worn by user 1 comprises a number of electrically connected elements including—in addition to the microphone, AD-converter and signal processing unit (DSP)—a digital to analogue converter (DA) and a receiver for converting an electric signal to an output sound for being presented to user 1. In an embodiment, the first listening device HA1 comprises an audio enhancement unit AE as illustrated in HA2. In an embodiment, both listening devices HA1 and HA2 are essentially identical, e.g. so that HA1 is specifically adapted to estimate the voice of user 2, e.g. as described above for HA2.

Figure 9:
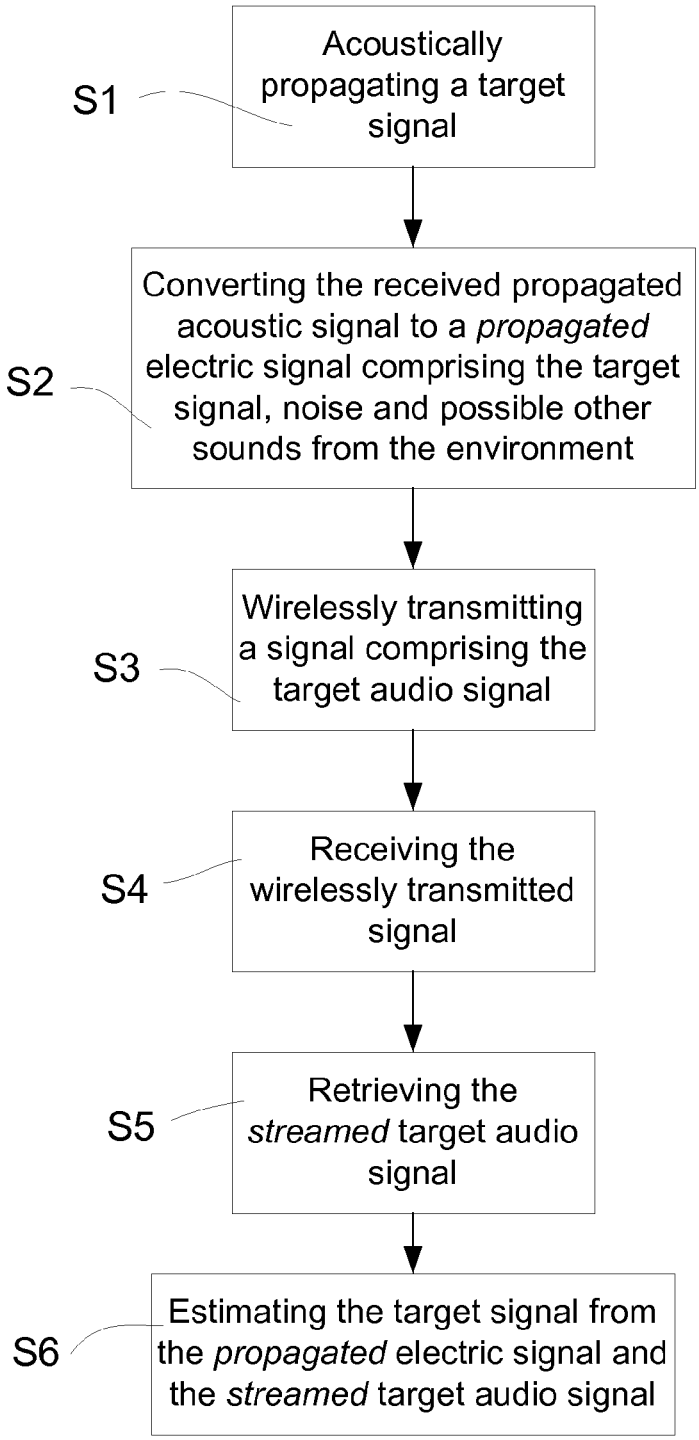
FIG. 9 shows a flow diagram of a method according to an embodiment of the present invention.

FIG. 9 shows a flow diagram of a method of enhancing an audio signal in a receiving device according to an embodiment of the present invention. The method comprises S1. Acoustically propagating a target signal from an acoustic source along an acoustic propagation path, providing a propagated acoustic signal at the receiving device;

S2. Converting the received propagated acoustic signal to a propagated electric signal, the received propagated acoustic signal comprising the target signal, noise and possible other sounds from the environment as modified by the propagation path from the acoustic source to the receiving device;

S3. Wirelessly transmitting a signal comprising the target audio signal to the receiving device;

S4. Receiving the wirelessly transmitted signal in the receiving device;

S5. Retrieving a streamed target audio signal from the wirelessly received signal comprising the target audio signal;

S6. Estimating the target signal from the propagated electric signal and the streamed target audio signal using an adaptive system or algorithm.

Preferably, at least some of the steps of the method are implemented as software algorithms. In an embodiment, at least step 6 (S6) is implemented as one or more software algorithms. Preferably such software algorithms are adapted for running on a signal processing unit of the receiving device, e.g. a listening device, e.g. a hearing instrument.

Figure 10A:
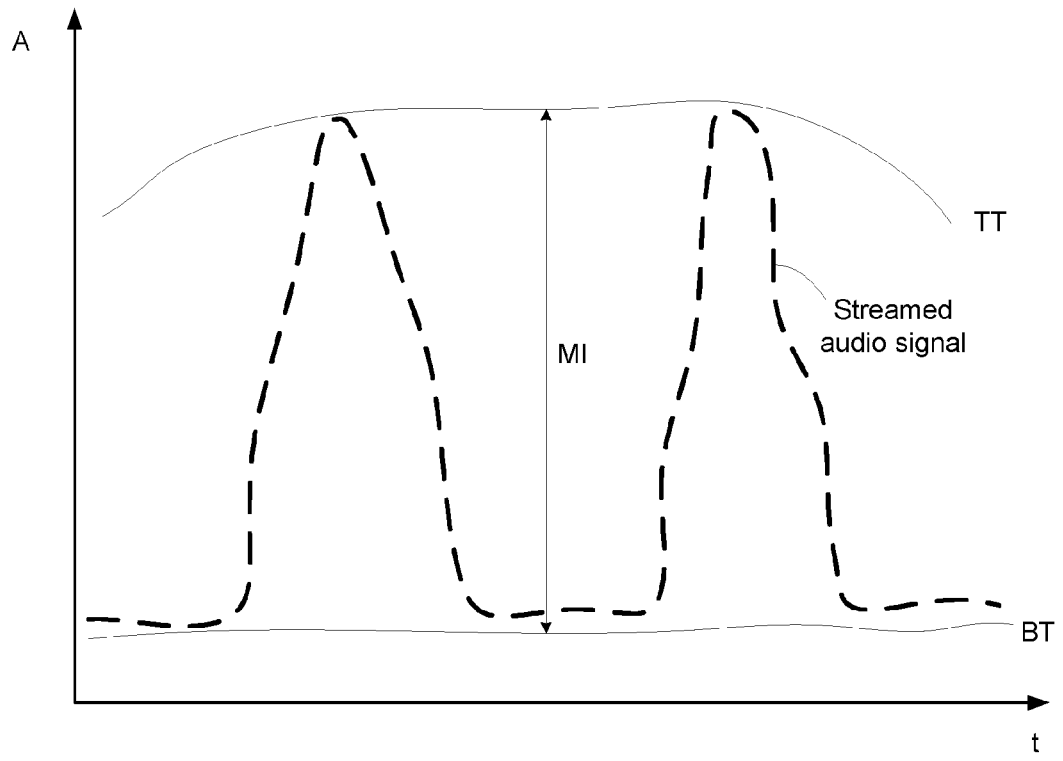
FIGS. 10*a* and 10*b* show an example of characteristics of the streamed target audio signal, here modulation index MI vs. time t (FIG. 10*a*) and resulting inputs to a processing algorithm providing gain G [dB] vs. modulation index MI (FIG. 10*b*)
Figure 10B:
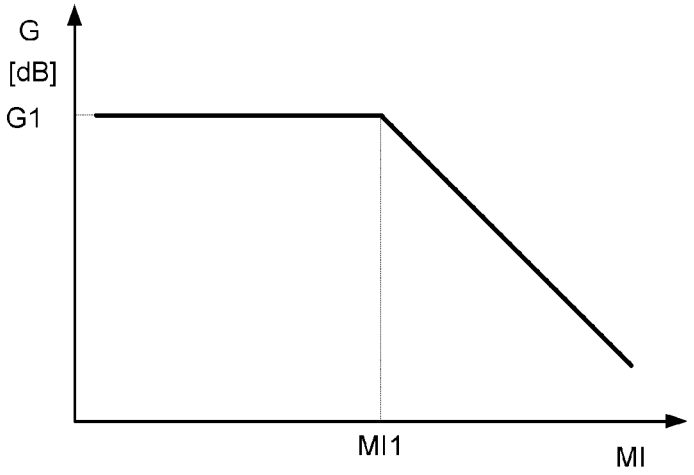

FIGS. 10*a* and 10*b* show an example of characteristics of the streamed target audio signal, here modulation index MI vs. time t (FIG. 10*a*) and resulting inputs to a processing algorithm providing gain G [dB] vs. modulation index MI (FIG. 10*b*). FIG. 10*a* schematically shows a voice signal input (amplitude A vs. time t) for a wirelessly received target audio signal (Streamed audio signal). The signal varies between a bottom tracker level (BT) and a top tracker level (TT). The modulation index (MI) indicates the ratios of (difference between in a dB-terms) the top tracker level and the bottom tracker level. The bottom tracker can be taken as an estimate of the noise floor, $N_{est}$., whereas the top tracker can be taken as an estimate of the signal (S) plus noise (N), $(S+N)_{est}$. Various aspects of noise reduction using the modulation index or modulation amplitude are discussed in WO 2005/086536 A1. These characteristics of the streamed target audio signal can be used in a voice controlled noise reduction algorithm to scale gain of the propagated electric signal as indicated in FIG. 10*b*, where gain (G [dB]) vs. modulation index (MI) is schematically shown. For values of the modulation index MI below a value MI1 (e.g. 0.5), gain G applied to the propagated electric signal is constant G1 [dB] (e.g 12 dB), whereas applied gain decreases linearly (in dB) for values of MI larger than MI1. The appropriate values of G1 and MI1 may vary depending on the acoustic environment, the specific listening device, etc. The characteristics of FIG. 10 can e.g. be used in an embodiment of an audio enhancement device as shown in FIG. 2*d*, where the estimator unit (E) comprises a voice detector for detecting a voice in the propagated electric signal and an algorithm for extracting a modulation index and determining a corresponding gain, and an activator unit (A) comprising an algorithm for correspondingly applying the appropriate gain to the propagated electric signal.

Figure 11A:
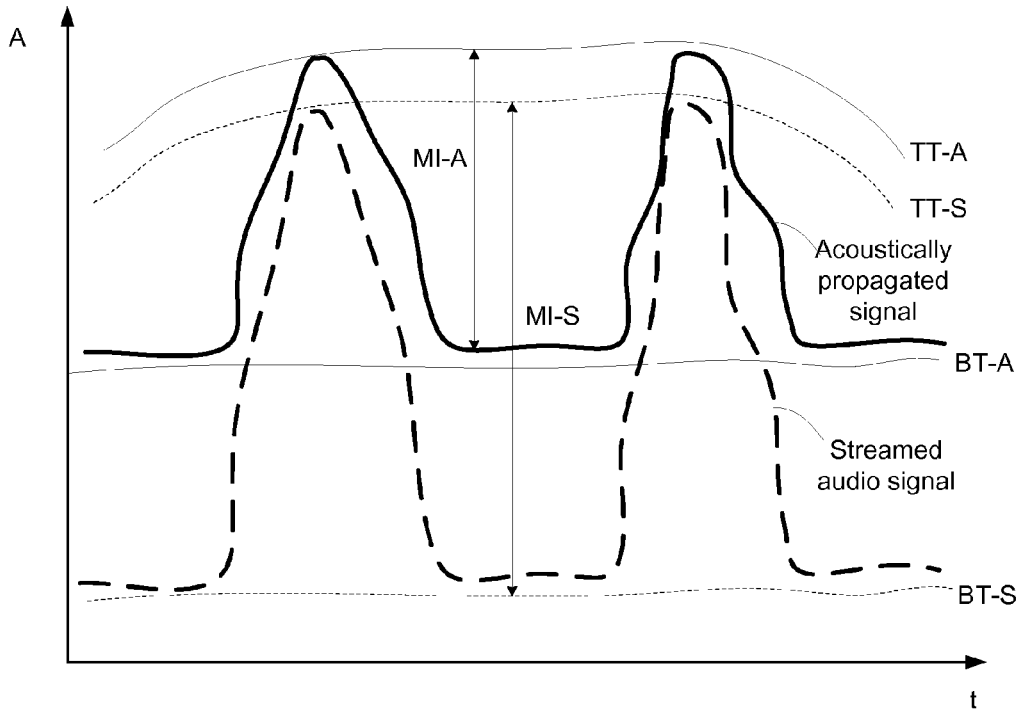
FIG. 11 shows an example of a comparison of characteristics of the streamed target audio signal with those of the acoustically propagated signal, here top and bottom trackers of modulation index MI vs. time t (FIG. 11*a*) and resulting inputs to processing algorithms, here providing incremental gain ΔG [dB] vs. frequency f (FIG. 11*b*) and incremental noise reduction ΔNR [dB] vs. frequency f (FIG. 11*c*)
Figure 11B:
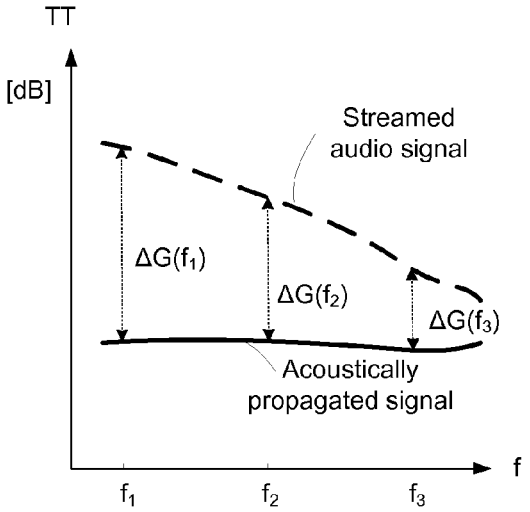
Figure 11C:
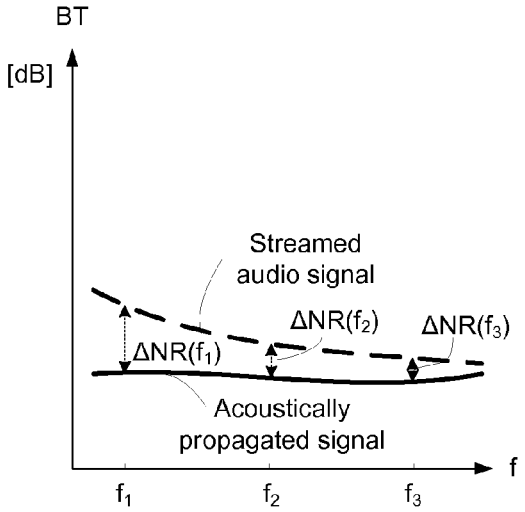

FIG. 11 shows an example of a comparison of characteristics of the streamed target audio signal with those of the acoustically propagated signal. FIG. 11*a* schematically shows a voice signal input (amplitude A vs. time t) for a wirelessly received streamed target audio signal (Streamed audio signal, dashed graph) and for the corresponding propagated electric signal (Acoustically propagated signal, solid graph). The signals vary between a bottom tracker level (BT) and a top tracker level (TT), here denoted BT-S, TT-S and BT-A, TT-A for the streamed target audio signal and the propagated electric signal, respectively. The modulation indices MI-S and MI-A for the streamed target audio signal and the propagated electric signal, respectively, are indicated. FIGS. 11*b* and 11*c* show resulting inputs to processing algorithms based on the respective top and bottom tracker data. FIG. 11*b* shows data for incremental gain ΔG [dB] vs. frequency f extracted as the difference between the corresponding top tracker (TT) vs. frequency data for the Streamed audio signal (dashed graph) and the Acoustically propagated signal (solid graph). These data are used as input to an algorithm for estimating signal gain. FIG. 11*c* shows data for incremental noise reduction ΔNR [dB] vs. frequency f extracted as the difference between the corresponding bottom tracker (BT) vs. frequency data for the Streamed audio signal (dashed graph) and the Acoustically propagated signal (solid graph). These data are used as input to an algorithm for estimating noise reduction. The characteristics of FIG. 11 can e.g. be used in an embodiment of an audio enhancement device as shown in FIG. 2*h* or 2*i*, where the audio enhancement unit (AS) comprises an estimator unit (E) comprising an algorithm for detecting top and bottom trackers vs. frequency of the streamed target audio signal as well as for the propagated electric signal and for providing data for the frequency dependence of the difference between the top trackers and between the bottom trackers for the streamed target audio signal and the propagated electric signal, respectively, and an activator unit (A) comprising algorithm(s) for correspondingly applying the appropriate gains to the appropriate parts of the propagated electric signal.

Figure 12A:
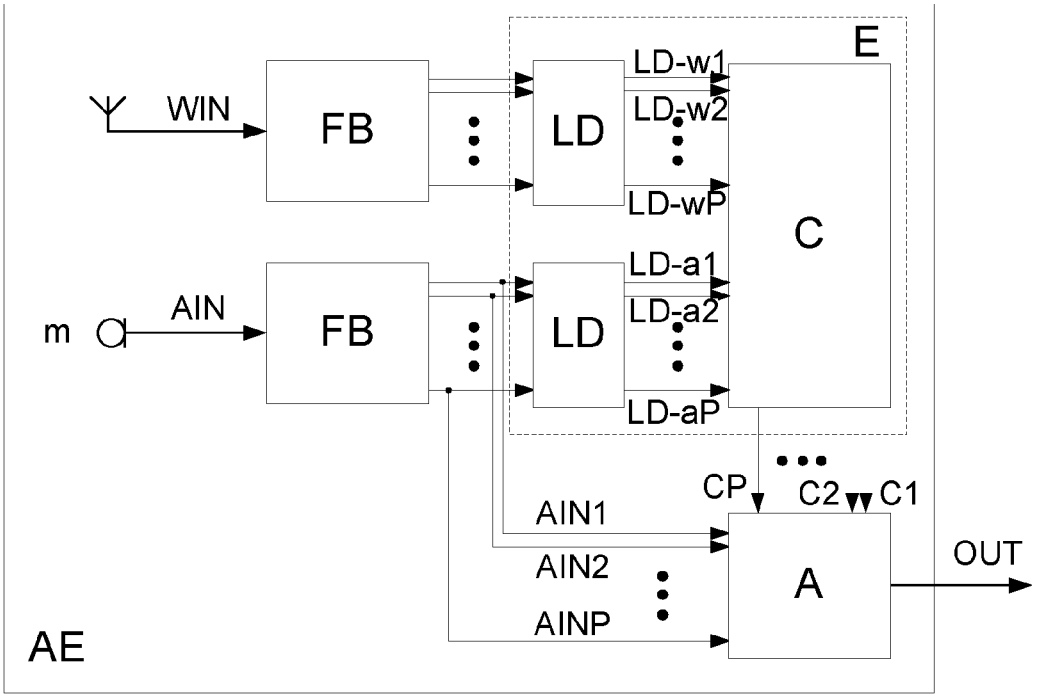
FIG. 12 shows an audio enhancement device according to an embodiment of the invention (FIG. 12A) and corresponding characteristics of the target signal, here level differences ΔG [dB] vs. frequency f (FIG. 12*b*).
Figure 12B:
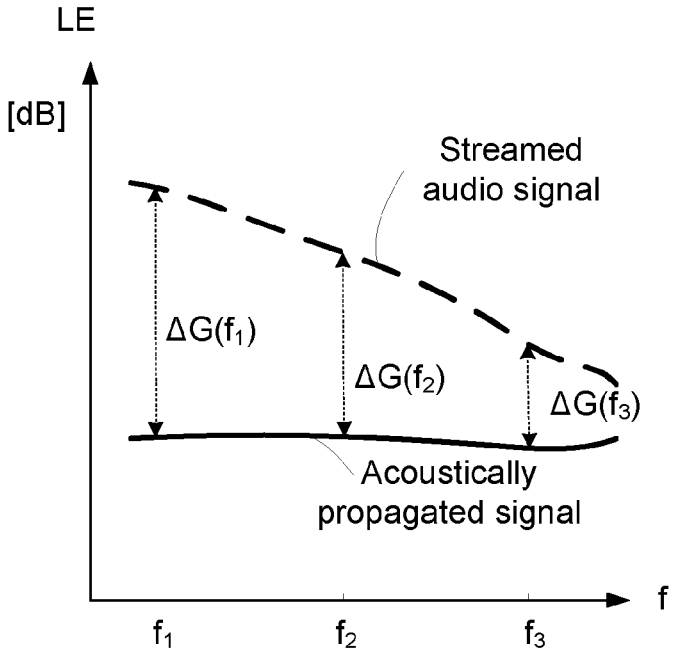

FIG. 12 shows an audio enhancement device according to an embodiment of the invention (FIG. 12A) and corresponding characteristics of the target signal, here level differences ΔG [dB] vs. frequency f (FIG. 12*b*). FIG. 12*a* shows an audio enhancement device (AE) comprising an antenna and corresponding receiver and demodulation circuitry for receiving (and demodulating) a wirelessly transmitted signal comprising a target audio signal, the receiver being adapted for providing as an output a streamed target signal WIN. The streamed target signal WIN is connected to a time to frequency conversion unit, here a filter bank FB. The filter bank splits the input signal WIN into a number P of time variant signals (WINp=WIN1, WIN2, . . . , WINP), each comprising a separate frequency range or band of the input signal. Likewise, the audio enhancement device comprises a microphone for picking up the acoustically propagated signal comprising a target signal and providing a propagated electric signal AIN, which is connected to a time to frequency conversion unit, here a filter bank FB. The filter bank splits the input signal AIN into a number P of time variant signals (AINp=AIN1, AIN2, . . . , AINP), each comprising a separate frequency range or band of the input signal. The time-frequency domain signals WINp and AINp are connected to each their level detection units (LD) for detecting an input level of the individual signal components WINp and AINp. The outputs LD-wp(=LD-w1, LD-w2, . . . , LD-wP) and LD-ap (=LD-a1, LD-a2, . . . , LD-aP) representing, respectively, input level vs. frequency f (or index p, p=1, 2, . . . , P) of the streamed target audio signal and the propagated electric signal are connected to a processing unit (C) for comparing the respective input levels at different frequencies, cf. FIG. 12*b* depicting LD-w(f) (or corresponding values of LD-wp and p) (dashed graph) and LD-a(f) (or corresponding values of LD-ap and p) (solid graph). Various aspects of level detection in a listening device is e.g. discussed in WO 2003/081947 A1. The two level detection units (LD) and the processing unit C together form part of an estimation unit (E), as indicated by the dashed outline enclosing these units. The processing unit calculates e.g. values ΔG(f)=LD-w(f)−LD-a(f) at different frequencies (e.g. ΔG(p)=LD-wp−LD-ap, p=1, 2, . . . , P). These values are fed to actuator unit (A) as signals Cp=(C1, C2, . . . , CP), where they are used as inputs to an algorithm for modifying the gain of the propagated electric signal AINp, which are inputs to the actuator unit (taken from the corresponding filter bank FB). The output OUT of the actuator unit A provides an enhanced estimate of the target signal. The output OUT may be either in a time domain for being further processed or presented directly to a user via an output transducer or in the time frequency domain adapted for being subject to further processing in this framework.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

REFERENCES

[Boll, 1979] Boll, S., Suppression of acoustic noise in speech using spectral subtraction, IEEE Trans. Acoustics, Speech and Signal Processing, Vol. 27, April 1979, pp. 113-120.

[Makhoul, 1975] Makhoul, J., Linear prediction: A tutorial review, Proceedings of the IEEE, Vol. 63, No. 4, April 1975, pp. 561-580.

[Rabiner, 1989] L. R. Rabiner, A Tutorial on Hidden Markov Models and Selected Applications in Speech Recognition, Proceedings of the IEEE, Vol. 77, No. 2, February 1989, pp. 257-286.

[Widrow et al., 1975] Bernard Widrow, John R. Glover, Jr., John M. McCool, John Kaunitz, Charles S. Williams, Robert H. Hean, James R. Zeidler, Eugene Dong, Jr., and Robert C. Goodlin, Adaptive Noise Cancelling: Principles and Applications, Proceedings of the IEEE, Vol. 63, No. 12, December 1975, pp. 1692-1716.

EP 1 107 472 A2 (SONY CORPORATION) 13 Jun. 2001

US 2005/0110700 A1 (STARKEY LABORATORIES) 26 May 2005

WO 2005/055654 (STARKEY LABORATORIES, OTICON) 16 Jun. 2005

WO 2005/053179 (STARKEY LABORATORIES, OTICON) 9 Jun. 2005

US 2008/0013763 A1 (SIEMENS AUDIOLOGISCHE TECHNIK) 17 Jan. 2008

US 2005/0255843 A1 (Hilpisch et al.) 17 Nov. 2005

WO 2004/077090 A1 (OTICON) 10 Sep. 2004

EP 1 956 589 A1 (OTICON) 13 Aug. 2008

WO 03/081947 A1 (OTICON) 2 Oct. 2003

WO 2005/086536 A1 (OTICON) 15 Sep. 2005

The invention claimed is:

1. A method of enhancing an audio signal in a receiving device, comprising:

acoustically propagating a target audio signal from an acoustic source at a first location along an acoustic propagation path to provide an acoustically propagated signal to the receiving device at a second location, the acoustically propagated signal reaching the receiving device being a mix of at least the target audio signal and acoustic noise from an environment as modified by the acoustic propagation path;

receiving the acoustically propagated signal at the receiving device at said second location;

converting the acoustically propagated signal received by the receiving device to a propagated electric signal;

wirelessly transmitting a clean version of the target audio signal from said first location to the receiving device at said second location as electromagnetic waves, the clean version of the target audio signal being devoid of said acoustic noise;

receiving the wirelessly transmitted clean version of the target audio signal in the receiving device at said second location;

retrieving a streamed clean target audio signal from the wirelessly received clean version of the target audio signal;

estimating the target audio signal from the propagated electric signal and the streamed clean target audio signal using an adaptive system, the adaptive system including an adaptive algorithm; and performing one of estimating the target audio signal from the propagated electric signal using the streamed clean target audio signal or a signal derived therefrom as an input to said adaptive algorithm to improve the estimate of the target audio signal; and estimating the target audio signal from the streamed clean target audio signal using the propagated electric signal or a signal derived therefrom as an input to said adaptive algorithm to improve the estimate of the target audio signal.

2. A method according to claim 1, further comprising:

estimating a delay difference between the propagated electric signal and the streamed clean target audio signal or between signals originating therefrom.

3. A method according to claim 2, further comprising:

using the delay difference in the estimating of the target audio signal.

4. A method according to claim 1, wherein said performing includes estimating the target audio signal from the propagated electric signal using the streamed clean target audio signal or a signal derived therefrom as the input to the adaptive algorithm to improve the estimate of the target audio signal.

5. A method according to claim 1, wherein said performing includes estimating the target audio signal from the streamed clean target audio signal using the propagated electric signal or a signal derived therefrom as the input to the adaptive algorithm to improve the estimate of the target audio signal.

6. A method according to claim 1 comprising performing at least some of the signal processing associated with enhancement of the audio signal in the receiving device in separate frequency ranges or bands.

7. A method according to claim 1, further comprising:

extracting characteristics of the target audio signal from the streamed clean target audio signal.

8. A method according to claim 7, wherein the characteristics of the target audio signal include one or more of the following:

a frequency spectrum, modulation at different frequencies, onset/offset characteristics, and input level.

9. A method according to claim 7, wherein the extracted characteristics from the streamed clean target audio signal are used as inputs to processing algorithms for improving the target audio signal.

10. A method according to claim 7, wherein the extracted characteristics from the streamed clean target audio signal are used to remove noise from distinct audio sources in the environment of the receiving device.

11. A method according to claim 1, further comprising:

extracting characteristics of the acoustic propagation path from the acoustically propagated signal.

12. A method according to claim 11, wherein the extracted characteristics of the acoustic propagation path include one or more of the following:

directional information, interaural difference cues, distance information, intensity, direct to reverberant energy ratio, and room impression.

13. A method according to claim 11, wherein the extracted characteristics of the acoustic propagation path are used to add spatial information to the target audio signal estimate.

14. A method according to claim 13, wherein the acoustically propagated signal is attenuated in or by the receiving device before being presented to a user.

15. An audio enhancement device for enhancing an audio signal, comprising:

at least one input transducer for receiving an acoustically propagated signal that is a mix of at least a target audio signal propagated from an acoustic source at a first location along an acoustic propagation path to the audio enhancement device and acoustic noise from an environment as modified by the acoustic propagation path, the at least one input transducer receiving said acoustically propagated signal at a second location and converting said acoustically propagated signal to a propagated electric signal;

a wireless receiver for receiving, at the second location, a clean version of the target audio signal via a wireless link between said wireless receiver and a wireless transmitter at said first location, the clean version of the target audio signal being devoid of said acoustic noise, the wireless receiver providing a streamed clean target audio signal from the wirelessly received clean version of the target audio signal;

a first adaptive system for estimating said target audio signal based on said propagated electric signal and said streamed clean target audio signal, the first adaptive system including an adaptive algorithm, wherein the first adaptive system is configured to estimate the target audio signal either from the propagated electric signal using the streamed clean target audio signal or a signal derived therefrom as an input to the adaptive algorithm, or from the streamed clean target audio signal using the propagated electric signal or a signal derived therefrom as an input to the adaptive algorithm.

16. An audio enhancement device according to claim 15 comprising a first estimator unit for estimating a delay difference between the propagated electric signal and the streamed clean target audio signal or signals originating therefrom.

17. An audio enhancement device according to claim 16, adapted for using the delay difference in the estimation of the target audio signal.

18. An audio enhancement device according to claim 16, wherein the first adaptive system is adapted to base its estimate of the target audio signal on the propagated electric signal and said estimated delay difference.

19. An audio enhancement device according to claim 16, wherein the first adaptive system is adapted to base its estimate of the target audio signal on the streamed clean target audio signal and said estimated delay difference.

20. An audio enhancement device according to claim 15, further comprising:

an output transducer for presenting the estimate of the target audio signal or an output from a signal processing unit comprising a further processing of said estimate of the target audio signal as a stimulus adapted to be perceived by a user as an output sound.

21. An audio enhancement device according to claim 15, further comprising:

an output transducer of a cochlear implant or of a bone conducting hearing device.

22. An audio enhancement device according to claim 15, wherein said first adaptive system comprises an adaptive filter for providing said estimate of the target audio signal, the adaptive filter comprising a variable filter part and an update algorithm part, the update algorithm part comprising said adaptive algorithm, and the variable filter part providing a transfer function that is automatically adjusted to changing inputs based on said adaptive algorithm of the update algorithm part.

23. An audio enhancement device according to claim 15, further comprising:

an estimator unit for estimating characteristics of the target audio signal from the streamed clean target audio signal, configured to provide that the extracted characteristics of the streamed clean target audio signal are used as inputs to processing algorithms for improving the target audio signal to provide the same characteristics in the processed version of the target audio signal estimate as in the streamed clean target audio signal.

24. An audio enhancement device according to claim 15, further comprising:

an estimator unit for extracting characteristics of the acoustic propagation path from the acoustically propagated signal, wherein extracted characteristics of the acoustic propagation path are used to add spatial information to the target audio signal estimate.

25. An audio enhancement device according to claim 16, comprising:

a hearing aid.

26. An audio enhancement system, comprising an audio source for generating an acoustic target signal and a transmitting device for generating a wireless signal comprising a representation of said target signal in the form of a target audio signal and a receiving device comprising an audio enhancement device according to claim 15.

* * * * *